US009700110B2

(12) United States Patent
Lee et al.

(10) Patent No.: US 9,700,110 B2
(45) Date of Patent: Jul. 11, 2017

(54) LUGGAGE

(71) Applicants: Paul Tee Hui Lee, Leicester (GB); Marc Tee Huang Lee, Singapore (CN)

(72) Inventors: Paul Tee Hui Lee, Leicester (GB); Marc Tee Huang Lee, Singapore (CN)

( * ) Notice: Subject to any disclaimer, the term of this patent is extended or adjusted under 35 U.S.C. 154(b) by 330 days.

(21) Appl. No.: 13/945,492

(22) Filed: Jul. 18, 2013

(65) Prior Publication Data

US 2014/0041979 A1 Feb. 13, 2014

Related U.S. Application Data

(63) Continuation of application No. 12/065,201, filed as application No. PCT/GB2006/003226 on Aug. 31, 2006, now Pat. No. 8,490,765.

(30) Foreign Application Priority Data

Aug. 31, 2005 (GB) ..... 0517720.9

(51) Int. Cl.

| | |
|---|---|
| ***A45C 5/14*** | (2006.01) |
| ***A45C 13/26*** | (2006.01) |
| *A45C 7/00* | (2006.01) |
| *A45C 9/00* | (2006.01) |
| *A45C 13/38* | (2006.01) |

(52) U.S. Cl.

CPC ..... *A45C 5/14* (2013.01); *A45C 5/146* (2013.01); *A45C 13/262* (2013.01); *A45C 7/0045* (2013.01); *A45C 9/00* (2013.01); *A45C 13/385* (2013.01)

(58) Field of Classification Search

CPC ..... A45C 5/14; A45C 5/146; A45C 13/262; A45C 7/0045; A45C 9/00; A45C 13/385; B62B 2202/24; B60B 33/0002; Y10T 16/1943

See application file for complete search history.

(56) References Cited

U.S. PATENT DOCUMENTS

| | | | |
|---|---|---|---|
| 2,002,836 | A | 5/1935 | Rossi |
| 4,228,877 | A | 10/1980 | Cothary |

(Continued)

FOREIGN PATENT DOCUMENTS

| | | |
|---|---|---|
| EP | 0142770 | 5/1985 |
| FR | 968949 | 12/1980 |

(Continued)

OTHER PUBLICATIONS

Coniglio, C. International Search Report PCT/BG2005/00749; Jun. 27, 2005, 3 pages, Netherland, Rijswijk.

*Primary Examiner* — Tri Mai

(74) *Attorney, Agent, or Firm* — Andrus Intellectual Property Law, LLP

(57) ABSTRACT

A wheeled luggage case having a luggage receptacle, with two opposing major walls and having end walls forming a luggage compartment. The handle is a flexing, bending, pivoting or otherwise angular mobile linkage. In one embodiment, a major wall of the receptacle is adapted to serve as a bottom wall that faces the ground during a wheeled mode of travel. In another embodiment, the luggage case is deployable in two modes of travel. The case has two alternative attachment points for the handle, one for pulling the case along in a first mode of travel and one for pulling the case along in a second mode of travel.

7 Claims, 19 Drawing Sheets

(56) References Cited

U.S. PATENT DOCUMENTS

| | | | | | |
|---|---|---|---|---|---|
| 4,261,447 | A | | 4/1981 | Arias et al. | |
| 4,273,222 | A | | 6/1981 | Cassimally et al. | |
| 4,460,188 | A | | 7/1984 | Maloof | |
| 4,508,202 | A | * | 4/1985 | Siegert | A45C 13/262 16/113.1 |
| 4,717,168 | A | * | 1/1988 | Moon, Sr. | B62B 3/02 188/19 |
| 4,890,705 | A | | 1/1990 | Pineda | |
| 5,044,476 | A | | 9/1991 | Seynhaeve | |
| 5,048,649 | A | | 9/1991 | Carpenter et al. | |
| 5,114,164 | A | | 5/1992 | Bothwell et al. | |
| 5,154,265 | A | * | 10/1992 | Capistrant | A45C 5/146 16/34 |
| 5,215,318 | A | * | 6/1993 | Capraro | A45C 5/14 280/1.5 |
| 5,249,438 | A | | 10/1993 | Rhaney | |
| 5,313,817 | A | | 5/1994 | Meinders | |
| 5,377,795 | A | | 1/1995 | Berman | |
| 5,407,039 | A | | 4/1995 | Alper et al. | |
| 5,484,046 | A | | 1/1996 | Alper et al. | |
| 5,501,308 | A | * | 3/1996 | King | A45C 5/14 190/102 |
| 5,555,960 | A | * | 9/1996 | Bartsch | A45C 13/262 190/115 |
| 5,630,521 | A | * | 5/1997 | Waddell | A45C 5/14 190/115 |
| 5,758,752 | A | | 6/1998 | King et al. | |
| 5,873,439 | A | | 2/1999 | Liang | |
| 6,082,510 | A | | 7/2000 | Liang | |
| 6,182,981 | B1 | | 2/2001 | Kuo | |
| 6,193,033 | B1 | | 2/2001 | Sadow et al. | |
| 6,237,734 | B1 | | 5/2001 | Chen | |
| 6,241,313 | B1 | | 6/2001 | Lenz et al. | |
| 6,345,414 | B1 | | 2/2002 | Chen | |
| 7,051,853 | B2 | | 5/2006 | Brown | |
| 7,246,805 | B2 | | 7/2007 | Neal et al. | |
| 7,748,508 | B2 | | 7/2010 | Lee et al. | |
| 8,118,145 | B1 | | 2/2012 | Hamamy et al. | |
| 2004/0050636 | A1 | * | 3/2004 | Forbes | B62B 5/068 190/18 A |
| 2010/0175960 | A1 | * | 7/2010 | Moskowitz | A45C 5/14 190/11 |

FOREIGN PATENT DOCUMENTS

| | | |
|---|---|---|
| FR | 2598897 | 11/1987 |
| GB | 2124589 | 2/1984 |
| GB | 2264481 | 9/1993 |
| JP | 2003-521262 | 8/1999 |
| JP | 3079288 | 5/2001 |
| RU | 2082304 | 2/1992 |
| RU | 2082305 | 2/1993 |
| WO | 99/34703 | 7/1999 |

* cited by examiner

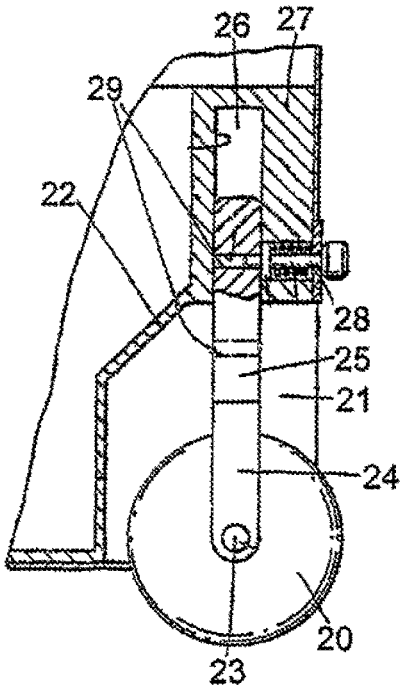
Fig. 3b
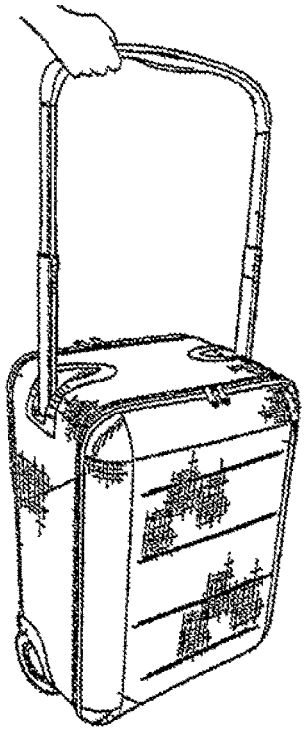
Fig. 3a
Fig. 4
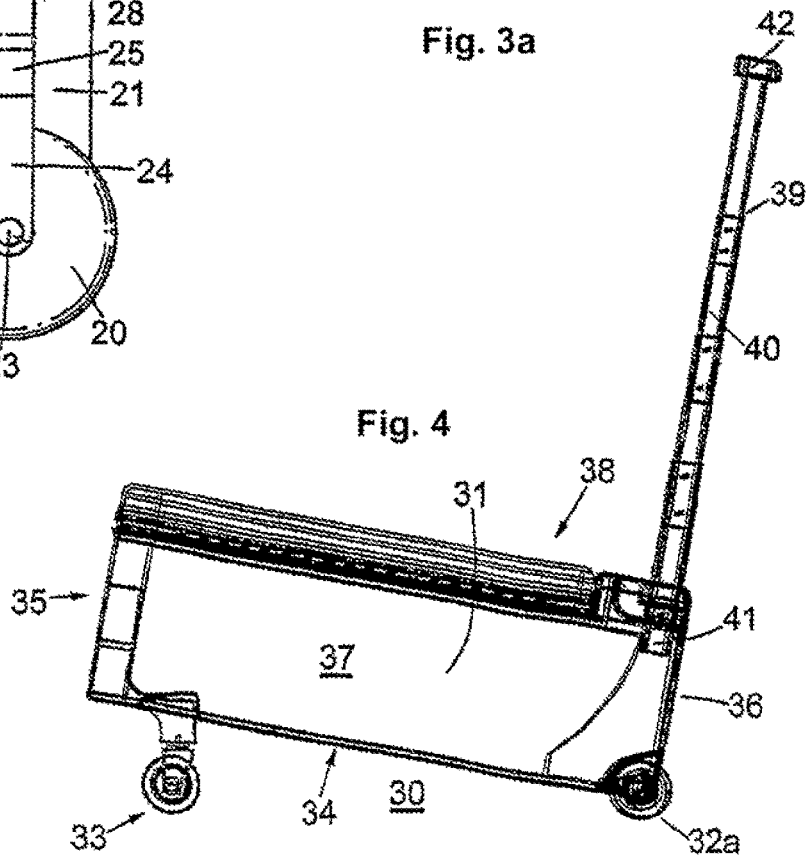

LUGGAGE

CROSS REFERENCE TO RELATED APPLICATIONS

This application is a continuation of U.S. patent application Ser. No. 12/065,201, filed Feb. 28, 2008, now U.S. Pat. No. 8,490,765, issuing Jul. 23, 2013, which '201 application claims the benefit of International Patent Application No. PCT/GB2006/003226, field Aug. 31, 2006, which claims priority from British Patent Application No. 0517720.9, filed Aug. 31, 2005.

FIELD OF THE INVENTION

This invention relates to traveller's luggage cases and more particularly to luggage cases which are equipped with wheels and a push-handle to facilitate movement of the case along a floor, walkway or the like.

BACKGROUND OF THE INVENTION

During the past few decades, people have been travelling over longer distances for longer periods, carrying with them larger and heavier suitcases. Lifting and manually carrying luggage at airports, railway stations, hotels or other sites is a task which is generally disliked by travellers. Rental luggage carts are available at certain sites of this kind but the renting process is itself an inconvenience and such carts do not remain with the traveller after leaving the site of rental. In order to mitigate this problem, wheeled luggage carriers which typically have a lightweight and foldable construction to facilitate handling and storage of the device when it is not in use, have been used. An example of such a carrier is shown in FIG. 1.

Such carriers are essentially small hand trucks of the type which have a platform on which the luggage case is rested, a pair of wheels which extend below one edge region of the platform and a handle which extends upward from the edge region. The user grasps and tilts the handle to lift the platform and luggage case upward from the underlying floor or the like and the carrier may then be pulled or pushed to the destination of the case. Such carriers are helpful but are not entirely free of inconveniences of their own. The carrier is not self-stabilized and it is not entirely self-supporting during movement. A person who is pulling or pushing such a carrier must continually exert additional effort in order to hold the carrier at the tilted orientation that enables it to be travelled along the floor or other surface. In the absence of such effort by the user, gravity pivots the carrier until either the platform or the handle itself contacts the floor.

When the luggage case is removed from the carrier the carrier itself becomes essentially still another separate piece of luggage which the traveller must contend with. The instability of such a carrier when it is tilted to the travelling orientation and the pivoting movement which occurs when the handle is released make it unsatisfactory for certain purposes such as for transporting a small child along with a luggage case.

Over the last couple of decades extensive efforts have been made to make the luggage case itself wheelable without the aid of a separate carrier and nowadays the majority of suitcases are wheeled. Wheeled cases generally have wheels at the base/bottom surface of the case that faces downward when the case is in an upright position. Wheeled case designs generally come in one of two configurations.

The first has wheels placed at the opposing corners of one or both ends of a narrow side of a conventional rectangular box-type suitcase. When in this orientation, in which the case can be wheeled along, the case is substantially higher than it is wide. An example of this type of wheeled case can be seen in FIG. 2. A pulling device such as, for example, a loop of cord is provided at one upperside end of the case The advantages of this arrangement are ease of changing between carrying and rolling the suitcase and potentially being able to roll the suitcase by one's side without obstruction to walking. However the significant disadvantages are difficulty in maneuverability due to a long narrow base, instability due to the narrow base and a high centre of gravity that lead to a propensity for the case to topple to one side or the other. Furthermore, the person pulling such a case generally has to lean over/stoop into an awkward posture to reach the pulling device and generally has inadequate stride clearance in choosing to pull the case behind them. Lengthening the pulling device is a poor option since it further compromises steerability and stability. For this reason, some such cases have a widened base. However, widening the base increases the carrying angle and makes hand carrying the case less ergonomic and more laborious.

The second common configuration of wheeled case as shown in FIG. 3*a*, known as a cart configuration, has wheels mounted to only one side edge of the narrow base with a retractable handle bar built into the case on the same side of the case to facilitate movement of the case. When the handle bar is extended, the unit may be tilted about the wheels and be operated in essentially the same manner as the previously discussed FIG. 1 luggage case carriers. The advantages of this arrangement include better maneuverability, stability and improved ergonomics. The retractable handle is generally easy to deploy and the wheels are easily 'activated' by inclining the case on the wheels. However, such a design is not self-supporting during transit and requires continuous lifting support from the user to hold it in the in the tilted state. It is thus good for small and light cases but large size and/or heavy suitcases with this design are, in wheeled operation, cumbersome and tiresome to move around due to their considerable size and weight. Indeed, for the elderly and infirm even the smaller and lighter cases with this design may still be a burden and whereas for short transits the burden may be minor, any such burden becomes increasingly irksome the longer the journey, more tiring the environment and more tired the individual is. Thus though this cart configuration of wheeled luggage case is relatively more stable in transit and ergonomic than cases with "wheels on long/narrow surface"; relatively maneuverable; and easy to activate it suffers from being not self-supporting during transit and may be strenuous with heavy loads and for long journeys and more difficult to use if the user's hand/arm has arthritis/deformity or other impairment. Stride clearance can also be an issue and vibrations can be transmitted to the hand (felt) during case transit on rough surface (eg. roads). This configuration of wheeled luggage case also do not facilitate piling up other items on the case (small surface area on top, makes whole luggage heavier because the extra load is placed away from the supporting wheels and towards the carrying hand).

A common variant on the above configuration, known as a spinner configuration, has a set of multidirectional wheels on the endwall and normally is wheeled along level on that endwall. This configuration of wheeled luggage case is self-supporting, and thus there is no not need to hold and support the case all the time during travel; it is multidirectional moving/steering and is easy to activate. However, it has a high center of gravity and wheels on short/narrow surface, thus is unstable and topples easily on cornering and uneven terrain. It is also non-ergonomic, thus strain on wrist and arm (eg when bearing a heavy load and traveling on eg carpet or over sloping ground). Again vibrations are transmitted to hand (felt) during case transit on rough surface (eg. road) and again there is difficulty with piling up other items on the case (small surface area on top).

In all of the previous designs the narrow base and high centre of gravity mean that the cases are unstable.

Back in the 1980's, some tried to attach wheels to the broad side of the suitcase where the surface was widest and push (or pull) the case lying on this widest side on the wheels like a trolley (see prior U.S. Pat. No. 6,041,900 Outerrigger Inc.). This provided better stability with a wide base and low centre of gravity. However, there are practical inconveniences with potential damage to the exposed wheels during transfer and storage and difficulty in packing and unpacking with a non-stationary suitcase. Also, stacking up of such cases within, for example, the cargo hold of a plane or coach becomes fraught with difficulty again because the cases cannot be relied upon to stay in place. Some have tried to make the wheels retractable with a holding mechanism, for example a catch or latch, in order to hold the wheel in its extended position during use. An example of this is shown in U.S. Pat. No. 5,407,039 Alper and Trevethick and illustrated in FIG. 3*b* below.

The multiple retractable wheels of these prior designs are flimsy, cumbersome and inconvenient to activate and retract. Moreover, they make the whole case too heavy for practical purposes. Since the weight of the case is concentrated on the pivotal points and/or support pins of the wheel retraction mechanisms, stronger and heavier materials are generally needed to prevent breakdown of the mechanisms, further adding to the overall weight of the case. In addition, the holding mechanisms are not always able to support the weight of the often heavy luggage for prolonged use which results in failure of the holding mechanism and luggage of this type will often have to be repaired or replaced on a regular basis. In view of these disadvantages, amongst others, the trolley case arrangement failed to take-off and was quickly abandoned.

In a recent substantial improvement to luggage case design we have proposed a luggage case as disclosed in the applicant's U.S. patent application Ser. No. 10/587,415, filed Feb. 28, 2005, now U.S. Pat. No. 7,748,508, issued Jul. 6, 2010, entitled "Wheeled Luggage Case" below with respect to FIG. 4. This case is adapted to be wheeled in the manner of a trolley and is self-supporting, with a low centre of gravity and wide base, and thus is stable: more maneuverable without toppling and more ergonomic, easier to push (optional use of body weight) than pull load, easy to pile other luggage on case (largest surface area possible for each case, initial stability with low centre of gravity and broad base). However, there is extra weight to the case due to the extra wheel and retraction mechanism and multi-segmented (4 to 5 section) retractable push handle and housing. The steering wheel assembly has a two-step deployment (or one step—but slightly more effort in deployment than 'cart' or 'spinner'). The deployment may be relatively tedious for short travelling distances. The case would also need a separate handle for cart functionality if it were to be given that functionality, adding weight.

There has been a long felt want for luggage which is (1) easily maneuverable with good stability and ergonomics and (2) convenient and practical for use. The present invention in its various aspects is directed to overcoming one or more of the problems discussed and may be embodied in cases of a diverse range of materials—eg hard or soft; plastics, fabric or hybrid construction, metal framed or not, a diverse range of shapes and sizes, large or small, and diverse general or specialist uses—eg large suitcases, small carry-on flight cases or even musical instrument and computer cases or the like.

SUMMARY OF THE INVENTION

According to a first aspect of the present invention there is provided wheeled luggage case having a luggage receptacle, the receptacle having two opposing major walls and having end walls forming a luggage compartment, whereof a major wall of the receptacle is adapted to serve as a bottom wall that faces the ground during a wheeled mode of travel of the luggage case, wherein said luggage case further comprises:—

(i) a plurality of support wheels located at one end of the bottom wall;

(ii) a retractable steering wheel assembly, located on the bottom wall, distanced, in use, from the support wheels, said steering wheel assembly having at least one wheel and being moveable between an active position at which the steering wheel assembly extends below the bottom wall of the luggage receptacle or an inactive position at which the steering wheel assembly is retracted; and (iii) a handle located at one end of the luggage receptacle for steering, pushing and/or pulling purposes;

wherein the luggage case is configured to be selectively deployable in a first mode of wheeled travel with the retractable steering wheel assembly and support wheels in ground engagement whereby the said bottom wall is facing the ground or in a second mode of wheeled travel with a different ground-engaging wheel arrangement whereby an end wall is facing the ground.

In preferred embodiments the second wheeled travel mode is provided by the steering wheel assembly or the supporting wheels, avoiding extra weight. For use of the supporting wheels in this manner it is preferred that the handle is located proximate the bottom wall for ease of grip and handling.

As used herein the expression "facing the ground" embraces not only a parallel facing relationship to the ground but also an inclined relationship where the wall (end wall or bottom wall) is juxtaposed to the ground but at an angle to the ground.

The handle may be a rigid telescopic or articulating retractable handle. In one preferred aspect the handle is a strap, i.e. band or tape, for pulling to draw the case along in the manner of a trailer. The strap is extendible from the luggage case and retractable and suitably is biased by a spring to resiliently retract and preferably is furled onto a spindle as it is retracted. The strap has substantial advantage in reducing the weight of the handle and hence the overall weight of the luggage case and plays an important role in weight reduction and especially so where the first and second wheeling modes are performed by discrete substructures.

Preferably, primarily for those preferred embodiments of the invention where the handle is rigid—ie not a flexible strap or the like, the extension deployment of the handle for use of the wheeled luggage case in its first mode of travel is linked to the retractable steering wheel assembly whereby movement of the handle relative to the receptacle moves the retractable steering wheel assembly between the active and inactive positions.

According to a further aspect of the present invention there is provided a wheeled luggage case having a luggage receptacle, the receptacle having two opposing major walls and having end walls forming a luggage compartment, whereof a major wall of the receptacle is adapted to serve as a bottom wall that faces the ground during use of the wheels in a first mode of wheeled travel of the luggage case, wherein said luggage case further comprises:—

(i) a plurality of support wheels located at one end of the bottom wall;

(ii) a retractable steering wheel assembly, located on the bottom wall, distanced, in use, from the support wheels, said steering wheel assembly having at least one wheel and being moveable between an active position at which the steering wheel assembly extends below the bottom wall of the luggage receptacle or an inactive position at which the steering wheel assembly retracted; and (iii) a handle located at one end of the luggage receptacle for steering, pushing and/or pulling purposes whereby movement of the handle relative to the receptacle moves only the retractable steering wheel assembly between the inactive and active positions to enable the luggage case to travel on the support wheels and steering wheel assembly. With this arrangement there is no need for the user to reach under the case to deploy the retractable steering wheel assembly nor to directly handle the wheels to deploy them, giving greater ease of use and convenience. Furthermore, the full set of wheels for trolley mode travel are rendered active for wheeled travel solely by movement of the handle, without having all trolley mode ground engaging wheels deployed by the handle. The support wheels are mounted in a fixed position on the case and not deployed by the handle. They are non-retractable but inactive when the retractable steering wheel assembly is retracted and rendered active when the steering wheel assembly is extended. This arrangement has great advantage over an arrangement having all wheels mechanically retractable, being more compact, more efficient and lighter in weight.

Suitably the handle has a rigid (pushable) handle stem pivoted to the receptacle and wherein the retractable steering wheel assembly is on a distal portion of the handle stem beyond the pivotal mounting of the handle stem to the receptacle. This direct fixed relationship between the handle stem and wheels confers optimal strength on the system, avoiding weakness of a geared or otherwise articulated relationship between the steering wheel assembly and the handle stem. Advantageously the steering wheel assembly is configured in a rigidly mounted relationship on the handle stem of the handle. The handle suitably has a handle stem that is pivoted to the receptacle at a location spaced at least partway along the long endwalls (sidewalls) of the receptacle from the pushing/pulling handle end of the case. This helps distribute the centre of gravity of the case better to counter tendency of the case to topple toward the user.

Preferably the steering wheel assembly and support wheels are configured such that with the steering wheel assembly in its active position, the base wall forms an acute angle with respect to the ground, and being inclined upwardly away from the support wheels. A significant benefit of this is that the support wheels are very effectively 'activated' on movement of the steering wheel assembly to the active position. The support wheels are only 'activated' when the steering wheel assembly is extended and tilts the case backwards. In other words, when the steering wheel assembly at the front end of the base of the case ('front' being the forward end of the case relative to the user when the user is pushing) is retracted, the front end of the base of the case will be in contact with the underlying support surface and serve as a frictional anchor even though the rear support wheels may themselves be in contact with the support surface/ground. When the steering wheel assembly is deployed this effectively activates the support wheels too since the base of the case is entirely borne on the wheels. This arrangement optimises the ease and convenience of activating and inactivating the wheeling system while minimising the weight of the wheeling system.

Preferably the steering wheel assembly, in the active position, extends further from the base wall than the support wheels. This arrangement whereby the luggage receptacle is tilted back towards the support wheels displaces the centre of gravity towards the user pushing the case and makes it easier to push and also by displacing the centre of gravity away from the steering wheel assembly, off-loads it and making it easier to steer. This arrangement also enables the retractable handle to tilt backwards away from the posterior surface of the luggage receptacle to allow for striding space; renders other luggage carried on top of the case less likely to fall off; and even enables the case to be converted to a push pram through use of simple accessorial and safety attachments.

Preferably the wheeled luggage comprises two support wheels and one retractable steering wheel assembly in a tricycle wheel configuration. This tricycle configuration optimises maneuverability with good stability while minimising total luggage weight and optimising ease and convenience of operating the wheeling system.

Preferably the retractable handle is pivoted to the receptacle with a substantially horizontal pivot axis and moves the retractable steering wheel assembly when the handle is moved about this pivot axis. Particularly preferably the retractable handle has telescopic arms that are curved or, less preferably, angled with a bend for improved ergonomics and leverage and suitably assisting stride clearance when the case is pulled at an incline on the support wheels or when the case is used as in push trolley wheeled travel mode. The arms may lie externally alongside the sidewalls of the case with the bend or curve lying in a plane substantially parallel to the case sidewalls. When the case is pulled at an incline on the support wheels with the curved or angled arm arrangement, the case is placed more upright and the centre of gravity is shifted more towards the rear support wheels making it easier to pull the load with less effort. The curved or angled arm arrangement provides better height positioning of the handle bar in the trolley-travel mode, improving ergonomics and allows the handlebar to be positioned closer to the user's body for better leverage.

Particularly preferably the retractable handle is movable between alternative angular positions relative to the case to allow for use of that handle to push or pull the case in more than one mode of wheeled travel. Suitably when the steering wheel assembly is in its inactive position the angle of the handle relative to the case suits the use of the handle to move the case at a relatively upright incline on the support wheels whereas when the steering wheel assembly is in its active position the angle of the handle relative to the case suits the use of the handle to move the case with the major wall as bottom wall, i.e. In so-called trolley travel mode.

Preferably the retractable wheel assembly is pivotally mounted or mounted in a slotted fashion. Preferably the luggage receptacle incorporates a recess in the end wall and/or the bottom wall adapted to accommodate the steering wheel assembly in the inactive position. Preferably the wheel of the steering wheel assembly is pivotally mounted in the assembly such that it can rotate about its own axis and about an axis substantially perpendicular to it. This arrangement facilitates steering. Preferably the steering wheel assembly, when in an active position, is supported by a support surface on the base wall of the case.

Preferably, when the steering wheel is retracted in an inactive position, the broad base of the case is parallel to the supporting ground on a 'stopper' at one end of the case base and on support wheels on the other end. Whether such a stopper is present or not suitably the arrangement is such that when the front steering wheel is extended into the active position, it tilts the case and automatically 'activates' the rear support wheels into play. In a further preferred arrangement the support wheels are recessed into and/or at a position above the bottom wall when the steering wheel assembly is inactivated/retracted.

The handle means can be moved between an active position at which the handle extends outwards from the luggage receptacle and can be engaged by the user and an inactive retracted position at which the handle is suitably contained substantially within the luggage receptacle. In some preferred embodiments the retracted handle may occupy a space close to but external to the luggage receptacle in order to not impinge on the capacity of the receptacle.

When the steering wheel and handle are retracted, the luggage case can be carried by a handle placed at the long narrow surface like an ordinary carrying case. Preferably, when the wheeling system is activated and the case tilted backwards, the handle is also tilted backwards towards the user to give greater pushing advantage to the user and preferably is furthermore tilted away from the posterior case surface to allow for greater striding space. Preferably, the rear end wall surface of the case is recessed to provide additional striding space.

The case may be made of robust material not only for durability and protection of the contents, but to be able to provide a platform for carrying other pieces of luggage stacked on top of it. When the steering wheel and handle are in their active positions, the case can act as a cart/trolley for carrying other pieces of luggage. A simple braking system may be installed for safety and convenience purposes and an optional umbrella attachment may be provided on the handle bar if desired. This latter is particularly useful in the context of the trolley travel since it frees up the user to use both hands in pushing the case.

In a further aspect the present invention provides a wheeled luggage case having a luggage receptacle, the receptacle having two opposing major walls and having end walls forming a luggage compartment, whereof a major wall of the receptacle is adapted to serve as a bottom wall that faces the ground during a wheeled mode of travel of the luggage case, wherein said luggage case further comprises:—

(i) a plurality of support wheels located at one end of the bottom wall;

(ii) a retractable steering wheel assembly, located on the bottom wall, distanced, in use, from the support wheels, said steering wheel assembly having at least one wheel and being moveable between an active position at which the steering wheel assembly extends below the bottom wall of the luggage receptacle or an inactive position at which the steering wheel assembly is retracted; and (iii) a handle located at one end of the luggage receptacle for steering and pulling purposes;

wherein the luggage case is configured to be deployable in a mode of wheeled travel with the retractable steering wheel assembly and support wheels in ground engagement whereby the said bottom wall is facing the ground, the handle comprising a flexing, bending, pivoting or otherwise angularly mobile linkage, preferably a flexible tape or strap, by means of which the luggage case may be pulled along in said mode of travel.

Preferably the handle functions as a belt or harness or has at or near its free end a clip means whereby the handle may be fastened to the user—eg to the user's belt or a shoulder strap or harness—to be pulled along by the user in a hands free manner. This facility is enabled by the exceptional stability, maneuverability and ease of displacement of the case in its 'trolley' or trailer mode of travel.

In a further aspect the present invention may provide a wheeled luggage case having the general configuration for trolley wheeled usage, preferably as defined by the preamble of any preceding aspect, and exploiting the exceptional stability by having at least one of the wheels of the luggage case powered by a motor and suitably adapted to be used as a vehicle for a passenger, having seating means and/or a footrest or backrest on top of the upper face/major wall of the case. This may have a remote control steering means for enabling the user to steer the case—eg a joystick or steering wheel.

BRIEF DESCRIPTION OF THE DRAWINGS

The present invention will now be described, by way of examples, with reference to the accompanying drawings wherein:

FIG. 3*a* illustrates a prior art wheeled luggage case with handle;

FIG. 3*b* illustrates a close up view of prior art retractable wheel;

FIG. 4 illustrates a side view of a luggage case as disclosed in the applicant's U.S. patent application Ser. No. 10/587,415, filed Feb. 28, 2005, now U.S. Pat. No. 7,748,508, issued Jul. 6, 2010, entitled "Wheeled Luggage Case", where the steering wheel and handle are in an active position

FIGS. 5 to 9 illustrate a first preferred embodiment of the invention, where FIG. 5 is a perspective view of the first preferred embodiment of wheeled luggage case of the present invention viewing the rear side wall (hinged) of the case and upper major wall (lid) of the case;

FIG. 6 is a perspective view of the case of FIG. 5 viewing the case toward the opposing major wall that serves as the bottom wall for recumbent, trolley-like travel;

FIG. 8 is a close-up view of a retractable foot/stopper that, with three other feet, supports the case off the ground when stood on its wall opposite the carry handle to protect the pushing handle, it may be moved out of the way by deploying movement of the pushing handle as shown in FIG. 9;

FIG. 9 shows a view similar to FIG. 8 illustrating operation of the feature shown in FIG. 8.

FIGS. 11 and 12, respectively illustrate firstly the luggage case in the relatively upright wheeled travel mode with the user pulling the case along by the handle supported on the main support wheels with the case at an incline, and secondly the user pushing the case along in the manner of a trolley;

FIG. 15*b* is the transitional state with the steering wheel assembly being moved to its stowed position and FIG. 15*c* is a view of the case oriented substantially upright at an incline and resting on the support wheels for the upright, tilted mode of travel (here the handle is shown fully retracted but could be used partly extended for this mode of travel if desired);

—FIG. 16*a* shows the wheeled luggage case as configured for the trolley mode of travel, FIG. 16*b* shows the underside of the case in the configuration for that mode, FIGS. 16*c* and 16*d* show the steering wheels at the handle end substantially collapsed back into the case and the support wheels at the opposing end readjusted back into their position to suit the upright or tilted mode of wheeled travel;

DESCRIPTION OF THE PREFERRED EMBODIMENTS

The present embodiments represent currently the best ways known to the applicant of putting the invention into practice. But they are not the only ways in which this can be achieved. They are illustrated, and they will now be described, by way of example only.

Figure 1:
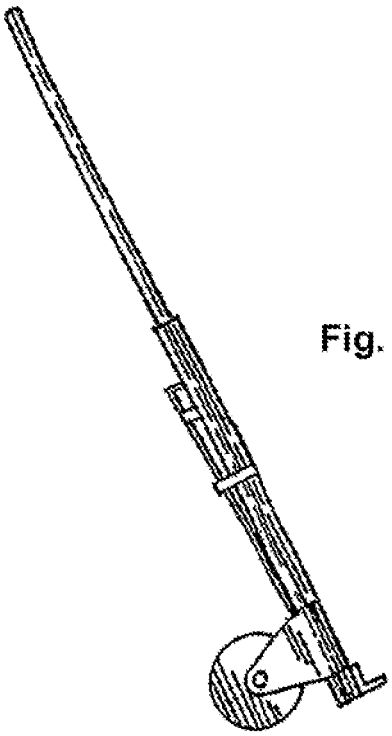
FIG. 1 illustrates a prior art wheeled luggage carrier.
Figure 2:
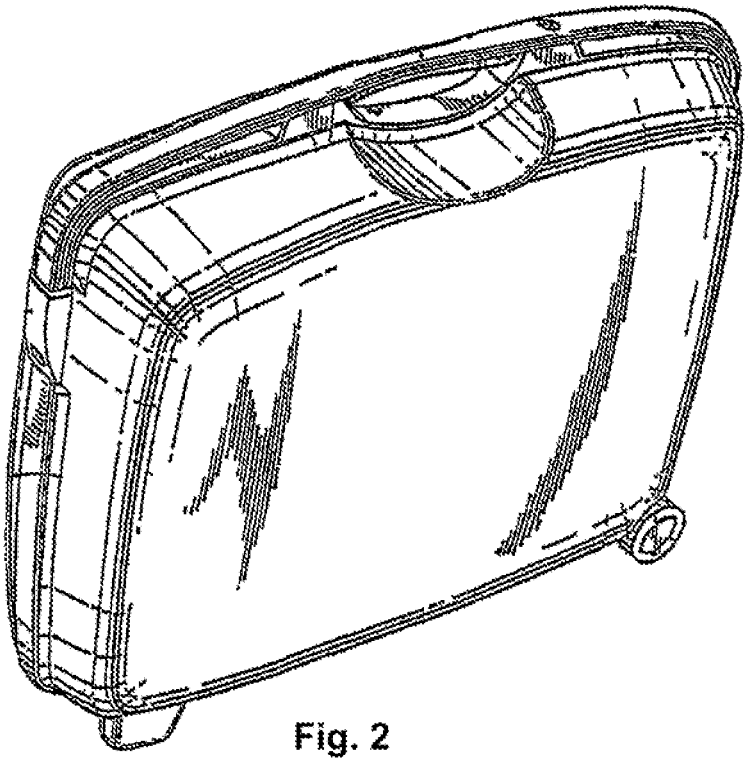
FIG. 2 illustrates a prior art wheeled luggage case.

FIGS. 1-3 show various prior art designs for mounting a luggage case on wheels. FIG. 1 shows a foldable frame upon which luggage would be placed to facilitate movement. FIG. 2 shows a case with wheels mounted at one end of a narrow edge surface. FIG. 3*a* shows an alternate wheel mounted case with a retractable handle to facilitate movement. All of these designs suffer from the various drawbacks above.

Few cases incorporate means for making the wheels retractable. There are obvious advantages to this, when not being wheeled the wheels can catch and snag on various articles. Also it is desirable to have a stationary receptacle when packing and unpacking. An example of a typical retraction means is shown in FIG. 3*b*.

A wheel 20 is partially situated in an alcove 21 formed in the frame of the receptacle 22. The axle 23 of the wheel 20 engages a fork 24 having a shank 25 that extends up into a vertical passage 26 in a thickened portion of the frame 27. The shank and passage are of sufficient length to enable the raising of the wheel to the point where the lower edge of the wheel is above the level of the underside of the receptacle. To hold the wheel at either the raised or the lowered position, the retraction means includes a pin 28 which extends through a passage in the frame and which may be entered into either of a pair of bores 29 which corresponds with either the raised or lowered position. A compression spring acts against a flange to resist withdrawal of the pin. The multiple retractable wheels along with the holding mechanisms are flimsy, cumbersome and inconvenient to activate and retract. More pertinently, they make the whole case too heavy for practical purposes.

Luggage cases often contain heavy loads and will be in use for long periods of time which puts large stresses onto the means holding the wheel in place. In the example in FIG. 3*b* all of the forces acting though the shank rests on the pin 28 holding the wheel in the lowered position. This generally results in failure of the holding mechanism after often unacceptably short periods of use.

Figure 4A:
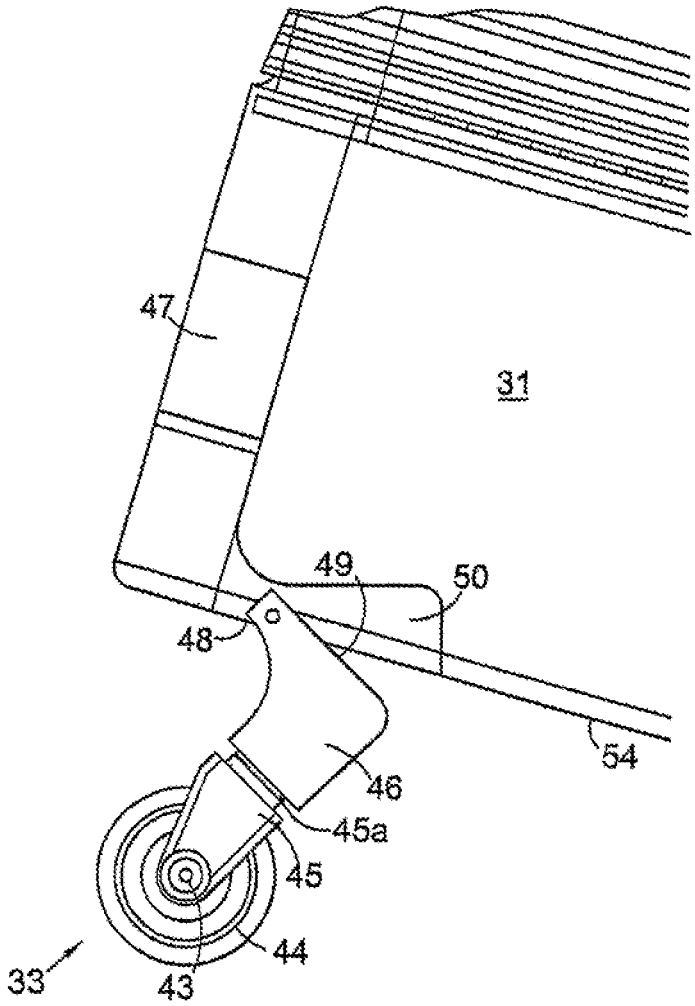
FIG. 4*a* is a close-up view of the steering wheel assembly.

FIG. 4 shows a wheeled luggage case 30 as disclosed in applicant's U.S. patent application Ser. No. 10/587,415, filed Feb. 28, 2015, now U.S. Pat. No. 7,748,508, issued Jul. 6, 2010, entitled "Wheeled Luggage Case" comprising a luggage receptacle 31, support wheel assemblies 32*a* (32*b* is not shown), a steering wheel assembly 33 and a retractable handle 39. The luggage receptacle 31 is defined by a base 34, a front end wall 35, a rear end wall 36, a side wall 37 (the other side wall not shown) which forms a luggage compartment. The lid 38 spans the top of the compartment when the case is closed. Receptacle 31 and lid 38 may jointly have the general configuration and construction of a typical traveller's suitcase except for the specialised structural features which will be hereinafter described.

In this particular example, the receptacle 31 and lid 38 jointly have a generally rectangular configuration. Both such components are formed of a durable material. The case 30 may, of course, have other shapes and be formed of other materials and is equally adaptable to any sized luggage case. It is preferred, although not essential in all cases, that the luggage receptacle 31 and lid 38 jointly have a length and a width which both exceed their height, lowering the centre of gravity, as this provides for maximum stability.

The lid can be fastened to the luggage receptacle by various means known to those skilled in the art and there are various ways in which the lid can be held closed including but not limited to zips, locks, clasps or any holding means. While the case 30 is designed to be wheeled along a floor, walkway or the like, it is preferably provided with a conventional hand grip (not shown) to enable carrying of the case when it is being moved for only a short distance. The invention is equally adaptable to luggage cases which have other forms of hinges, closures, latching means and provisions for carrying the case.

A generally U-shaped retractable handle 39 enables the traveller to push the case 30 while walking in a normal upright posture. The handle has a pair of coplanar parallel arms 40 which can be retracted into a chamber 41 so that the top of the handle does not protrude beyond the lid 38 when not in use and does not interfere with storage of the case in restricted spaces. The opposite ends of the arms are linked by a cross member 42 which is grasped by the user during travel of the case. The handle 39 is extendible and contractible as each arm is formed by telescoping members. Means are provided to lock the arms in position during use which can optionally allow the traveller to select the degree of extension.

Spaced apart support wheel assemblies 32*a* and 32*b* (not shown) are disposed at opposite side regions of the luggage receptacle 31 in proximity to the back end wall 36 of receptacle 31 and extend downward to contact the supporting surface.

The inclination of the base of the case from the supporting surface tilts the handle bar backwards to provide striding space. A portion of the posterior surface of the case is optionally recessed to provide additional striding space (see drawing). A steering wheel assembly 33 is pivotally movable between an active position in which the steering wheel assembly 33 extends below the bottom wall of the luggage receptacle 34 as shown and an inactive position in which the steering wheel assembly is substantially contained within the luggage receptacle and does not protrude significantly beyond the front wall 35 and does not interfere with storage of the case in restricted spaces.

Turning now to FIGS. 5 to 9, the first preferred embodiment of the present invention will now be described. This takes and improves on the principles of our earlier wheeled luggage case invention described above in relation to FIGS. 4 and 4*a* by allowing for multiple modes of wheeled travel and by providing an extremely efficient means for deploying the steering wheel assembly.

In common with our earlier wheeled luggage case, the case of the present invention is capable of being hand carried like a standard hand carry suitcase as well as being pushed and used as a push trolley/cart. It is also capable of being pulled by the side of the user level on uni-directional or preferably multi-directional wheels mounted on an endwall of the case using a straight or preferably curved/"bent" retractable handle to optimise ergonomics and leverage. In a third mode of wheeled travel the case may be tilted on the swivel wheels of the endwall to be wheeled in a cart manner—ie at an incline with a major wall leading rather than an endwall. The improved luggage case thus has multiple modes of wheeled travel to cope with various circumstances during transport. This versatility allows the user to select the optimal mode of travel to best suit the situation or terrain being traversed.

The first embodiment shown in FIGS. 5 to 9 comprises a wheeled luggage case 55 having a luggage receptacle 56 with non-retractable support wheel assemblies 57*a*, 57*b*, a retractable steering wheel assembly 58 and a retractable handle 59.

Luggage receptacle 56 has a base, or bottom wall 60, a front end wall 61, a rear end wall 62, a first side wall 63 and opposing side wall 64 which collectively define a luggage compartment that is enclosed by a lid 65 that spans the top of the compartment when the case is closed. As with our previous design of luggage case, the receptacle 55 and lid 65 may jointly have the general configuration and construction of a typical hand-carrying traveller's suitcase except for the specialised structural features to be described. It is suitably substantially rectangular in shape, with two opposing long wide (major) surfaces, two opposing long/narrow end wall surfaces and two short/narrow end wall surfaces. A carry handle for lifting may be provided on one of the long narrow surfaces and/or short narrow end walls.

As with the FIG. 4 wheeled case, this first preferred embodiment of wheeled case 55 may be pushed along in the manner of a trolley by the traveller using the generally U-shaped retractable handle 59 while walking in a normal upright posture. The pair of plane parallel arms 66*a*, 66*b* of the handle 59 retract in a telescopic fashion. The opposing upper ends of the arms are linked by an upper cross member that functions as a handle bar 67. In this preferred embodiment of the wheeled case the retractable handle 59 has arms 66 that are not straight but instead curved. Furthermore, unlike the FIG. 4 design of case, the preferred embodiment of wheeled case carries the steering wheel assembly 58, here comprising a castor wheel 58, on a lower cross member 68 that links the bottom ends of the arms 66 together. Thus, though it is stowed within the end wall recess of the case, the steerable wheel assembly 58 is pivotally mounted to the lower cross member 68 of the handle 59 and not to the bottom wall 60 of the case.

Furthermore, the retractable handle 59, unlike that of the FIG. 4 case, is externally mounted to the sidewalls of the case (though in variants it could be internally mounted, having the handle stem/arms penetrating through the receptacle). An arm 66*a* of the handle 59 is pivotally mounted by a pivot 69*a* to one side wall of the case and the other arm 66*b* being pivotally mounted by pivot 69*b* to the other side of the case. Accordingly, the retractable handle 59 is able to not only move in a telescopic extending manner relative to the case but is also able to pivot about the case and when moving pivotally about the case, it alters the position of the steering wheel assembly 58 that is mounted to the lower cross member 68, enabling its re-positioning from the stowed position in the receptacle 70 in the end wall of the case to an active position abutting and supporting the underside of the case. Stages of deployment of the handle 59 and associated steering wheel assembly 58 are shown in FIGS. 7*a* to 7*f*.

Figure 5:
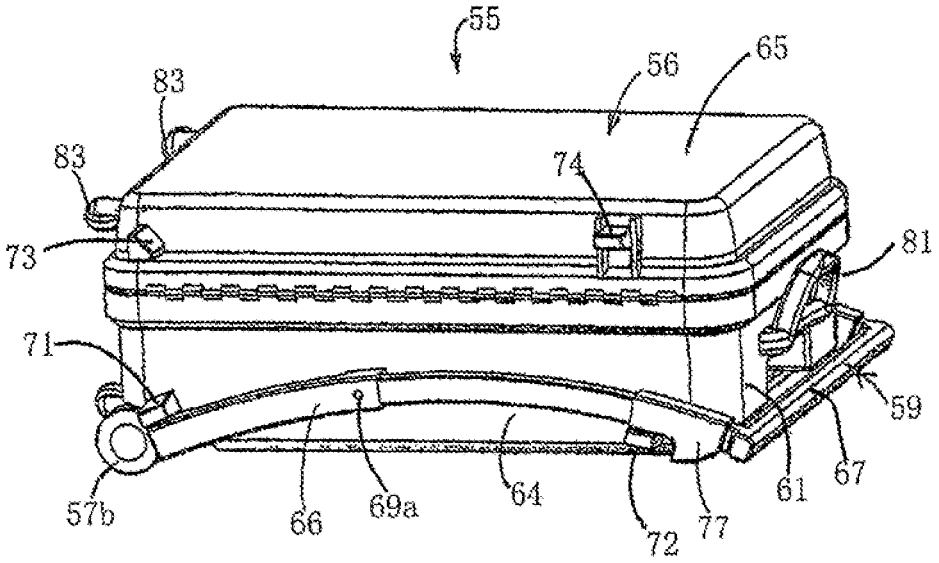
Figure 6:
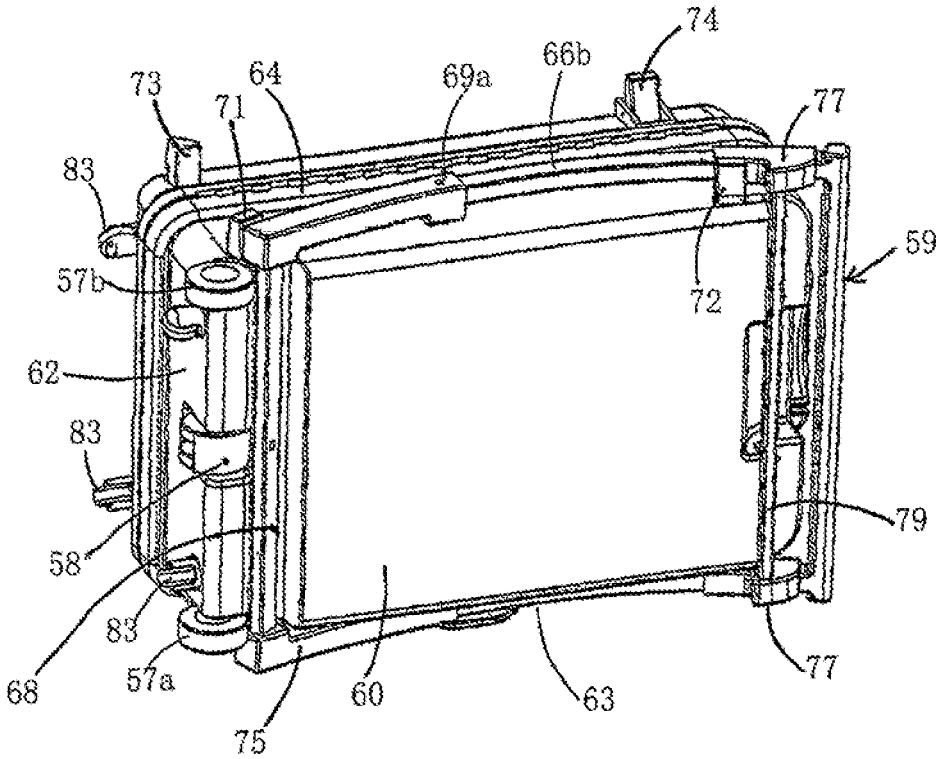

Further features of the wheeled luggage case construction apparent from FIGS. 5 and 6 are the provision of end stops to limit the extent of pivotal movement of the handle 59 about pivots 69*a*, 69*b*. When the handle 59 and associated steering wheel assembly 58 are in the stowed position, the handle is detained against a first end stop 72 adjacent handle bar 67 and at its other end by a second end stop 71. Each end stop 71, 72 has the form of a projecting lug and doubles as a small foot that, together with two other such lugs 73,74, space the case sidewall from the ground to protect the arms of the handle 59 from being pressed against the ground. A lug-shaped foot/end stop 73 is provided to detain the handle 59 when it is pivoted to the fully deployed state of the steering wheel assembly 58. A further foot 74 of the four lug-like feet/stops is adapted to retract or deflect to allow deployment of the handle 59, as will be further described later with reference to FIGS. 8 and 9.

The retractable handle assembly has each arm 66*a*, 66*b* composed of telescoping sections. A bottom section 75 of each arm 66*a*, 66*b* carries the bottom cross bar 68 to which the steering wheel assembly 58 is mounted. This bottom section 75 is at its "upper" end mounted to the case side wall by the respective pivot 69*a*, 69*b* and it has the form of a tubular sleeve in which a mid-section 76 of the arm 66*a*, 66*b* is telescopingly slidingly received. Mid-section 76 of each arm 66*a*, 66*b* is also shaped as a tubular sleeve and has telescopingly, slidingly received therein an upper arm section 78, the "upper" end of which bears the handle bar 67. At the "upper" end of each mid section 76 there is a further tubular body 77 that is shaped with a hook-like formation that appears to hook behind the first end stop 72. These hook-like tubular bodies 77 of each arm 66*a*, 66*b* are linked by a mid-crossbar 79 and their hook-like form is to project sufficiently from the arms 66*a,b* to position the cross-bar 79 to be able to nest into a rebate 80 in the end of the bottom wall 60 of the case. This mid-crossbar 79 strengthens the handle assembly 59 and additionally helps to restrain the handle assembly 59 from unintentionally pivotally deploying, when used in the inclined/upright wheeled mode, by being accommodated within the rebate 80 in the end of the bottom wall 60 of the case.

Further features of the wheeled luggage case of the first preferred embodiment that may be seen in FIGS. 5 and 6 include provision of conventional hand carrying handles 81, 82 on one end and one side wall of the case respectively. Small castor wheels 83 are also provided on the end wall of the case opposite to the end wall that has hand carrying handle 81 to allow for the mode of wheeled travel in which the case is pulled along upright at the traveller's side, suitably with the user gripping the same pushing/pulling handlebar 67 for this mode of wheeled travel as is used for the trolley mode of wheeled travel. A recess or cut-out 90 in the endwall of the luggage case receptacle adjacent the stowed position of the handlebar 67' suits gripping access to the handle bar when it is stowed.

Figure 7A:
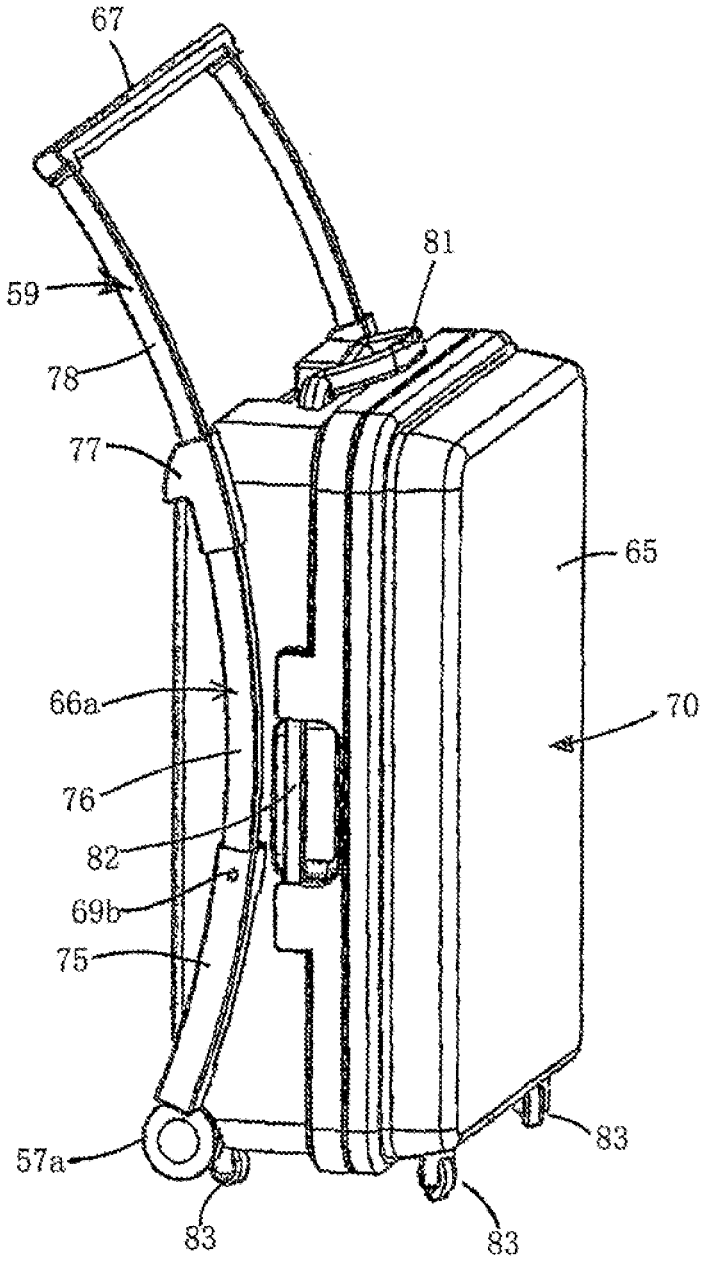
FIG. 7*a* is a perspective view similar to FIG. 5 but of the opposing side wall of the case that opens and showing the case in upright level wheeled travel mode on four multi-directional wheels with the retractable handle partly telescopically extended for ease of reach—the case may also be wheeled along inclined on two of the four multi-directional wheels when the need arises.
Figure 7B:
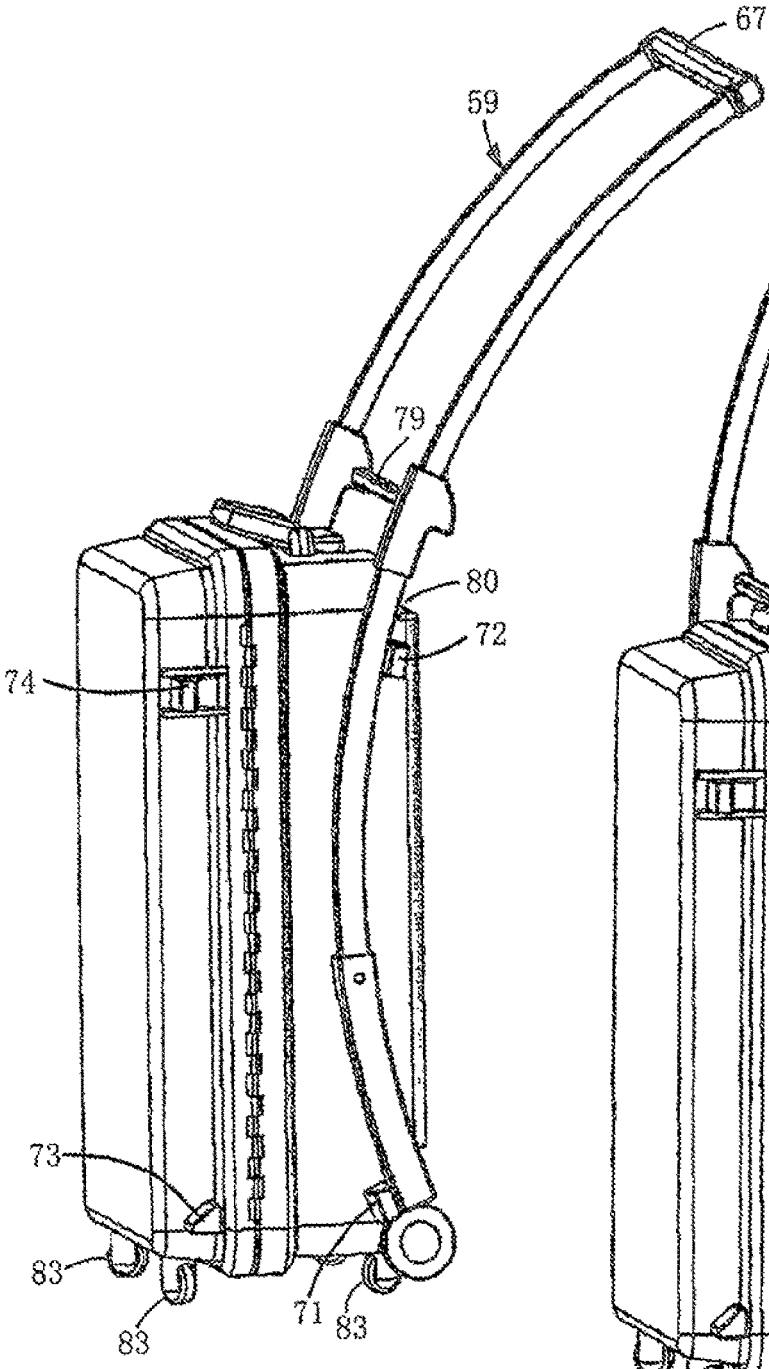
FIGS. 7*b* to 7*f* show respective stages of converting the luggage case for trolley-like travel by further extending the retractable handle and moving the retractable handle about its pivotal mount to the case whereby the steering wheel assembly that is mounted to a lower end extension of the retractable handle is concurrently moved from an inactive position recessed into the bottom and/or end wall of the case to an active position protruding downwardly from the bottom wall of the case.
Figure 7C:
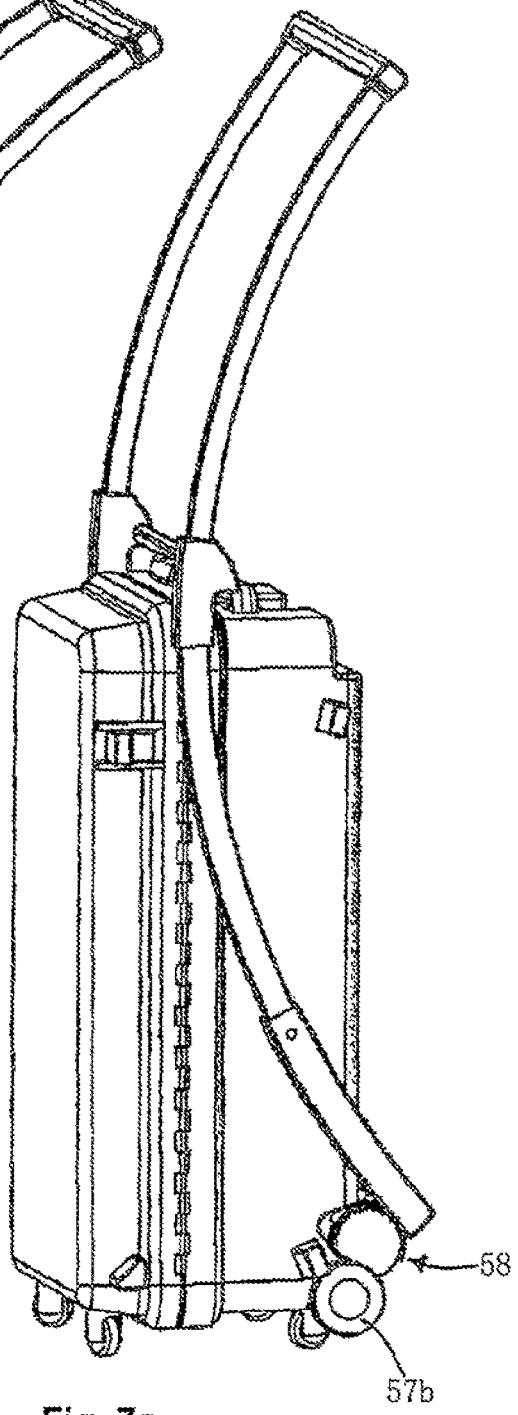
Figure 7D:
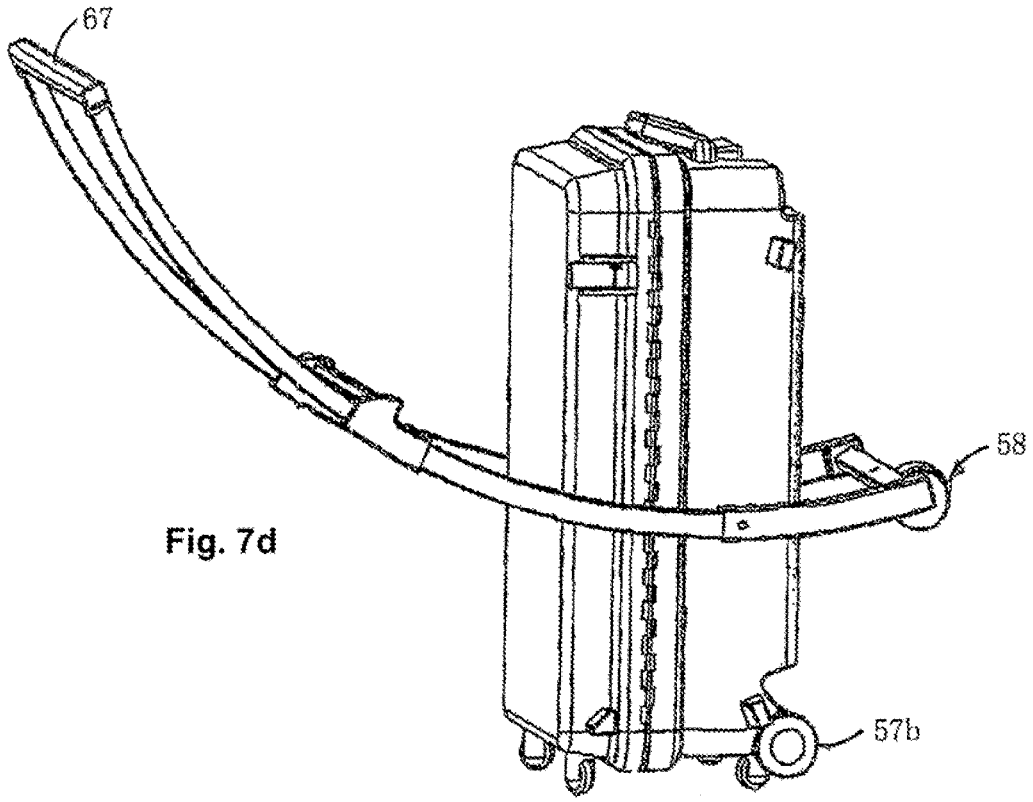
Figure 7E:
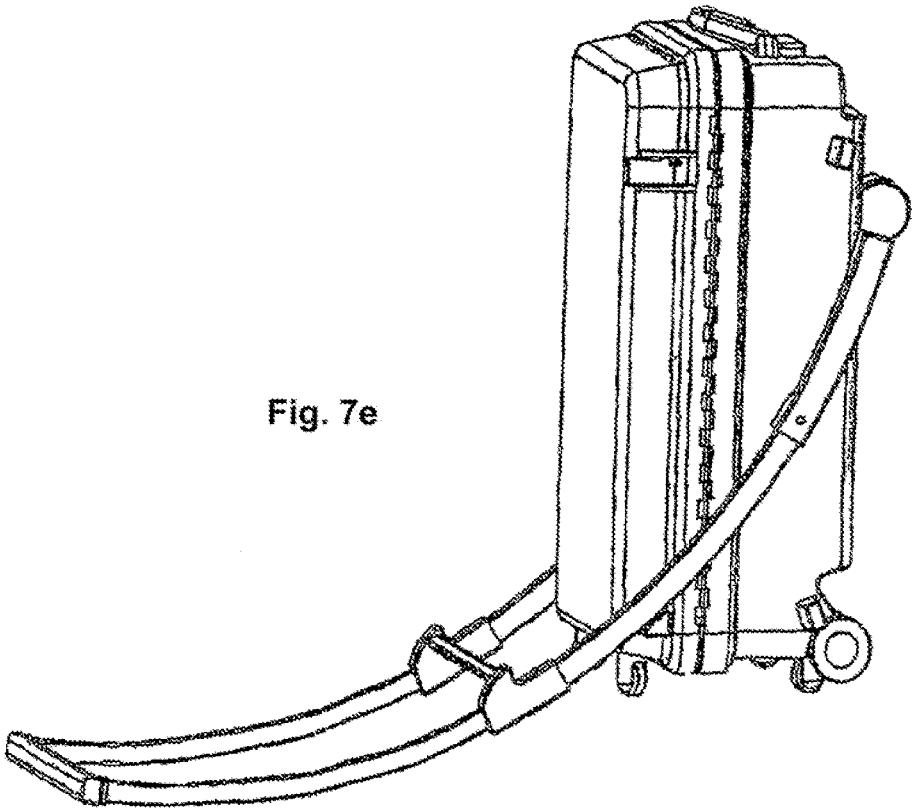
Figure 7F:
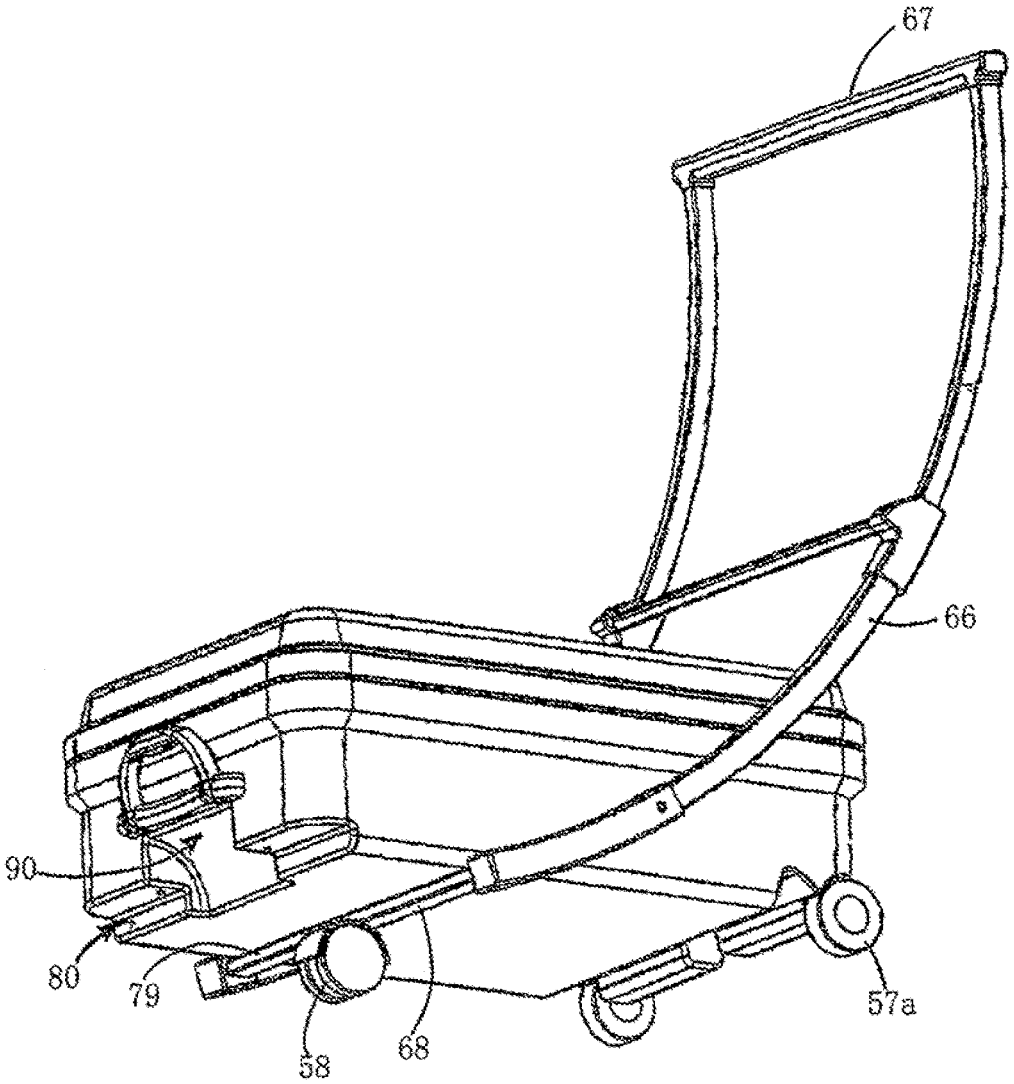

Turning to FIGS. 7*a* to 7*f*, these show the transition of the case between the two modes of wheeled travel. In the first of these figures the case is in its mode for upright travel at the user's side. The handle 59 is in its inactive/stowed pivotal position in common with FIGS. 5 and 6, but is at a position that is partially telescopically extended by pulling of the handle bar 67 drawing the upper section 78 of the handle bar out from the mid sections 76 and is suitably locked at that position. This partial telescopic extension position is selected to suit the reach of the user relative to the height of the case In FIG. 7*b*, the handle 59 is telescopically extended yet further, drawing the mid section 76 of each arm 66*a*, 66*b* further from within the bottom sections 75. This action raises the mid-crossbar 79 from within rebate 80 of the case end wall effectively unlocking it, raising it sufficiently to allow it to clear the end wall and the handle 59 to thence be tilted about the pivot 69*a*, 69*b*. As this happens, the steering wheel assembly 58 is concurrently lifted away from its recess 70 in the base wall 60 of the case. In FIG. 7*d*, the handle 59 is tilted yet further about pivots 69*a*, 69*b*, and in the process having pushed out of the way the foot/stopper 74.

Ultimately the further tilting of the handle 59 brings it to its extreme rest position corresponding to the active state of the steering wheel assembly 58 at which the lower crossbar 68 is pressed against the base wall 60 of the case and the mid-section 76 of arms 66*a*, 66*b* press against the third end stop 73. The lower crossbar 68 functions as a horizontal locking bar that blocks further pivotal movement of the handle 59 relative to the case and is held in position by the weight of the case, avoiding the need for a locking arrangement to lock the steering wheel assembly in active state, and spreads the weight of the case over a relatively large surface area helping to reduce the stress on the pivot.

The third end stop 73 helps to prevent excessive force being applied to the steering wheel assembly 58 and pivots 69*a*, 69*b* in pivotal deployment of the handle 59 or from the weight of the luggage.

Figure 8:
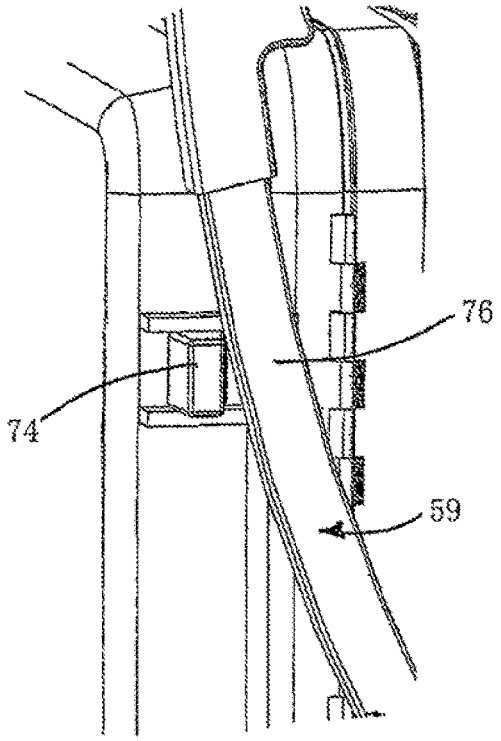
Figure 9:
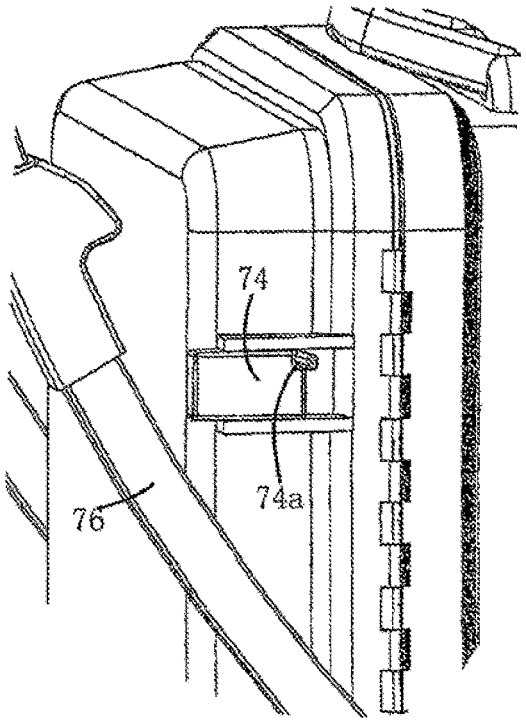

Referring to FIGS. 8 and 9, the stopper/foot 74 is pivotally mounted to the case to be pushed back out of the way by the handle arm mid-section 76 as the handle 59 is raised. As can be seen from FIG. 9, the stopper/foot 74 has an upstanding lever pin 74*a* which will catch against the arm mid-section 76 when the arm is returned toward its stowed state to return the handle 59 and steering wheel assembly 58 to the inactive position. Accordingly, the mid-section 76 on being returned to its stowed position will push against the lever pin 74*a* and thereby pull the stopper/foot 74 back to its extended position.

Turning now to the second preferred embodiment of the invention illustrated in FIGS. 10*a* to 10*d*, the wheeled luggage case here has a steering wheel assembly comprising a pair of steering wheels 58*a*, 58*b* each mounted to the lower end of the handle 59, one on each side of the case. This second preferred embodiment does not have either a mid or lower cross member and the pivotal mounting of the handle 59 to the case side walls is articulated. Each arm 76*a*', 76*b*' is mounted to the respective side wall of the case by a pivot

Figure 10A:
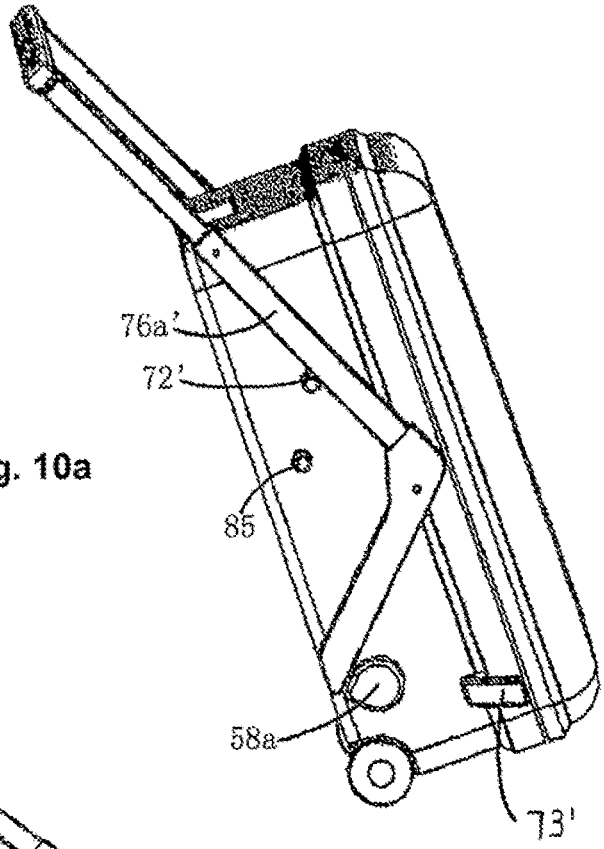
FIG. 10*a* is a side view of a case that differs primarily from the first embodiment in having, instead of a tricycle configuration with a central steering wheel on a crossbar, a pair of steering wheels each to either side of the case, the handle here being shown partly extended but in its stowed pivotal position whereby the steering wheels are in the inactive position alongside the side walls of the case and the case is in its upright wheeled travel mode.
Figure 10B:
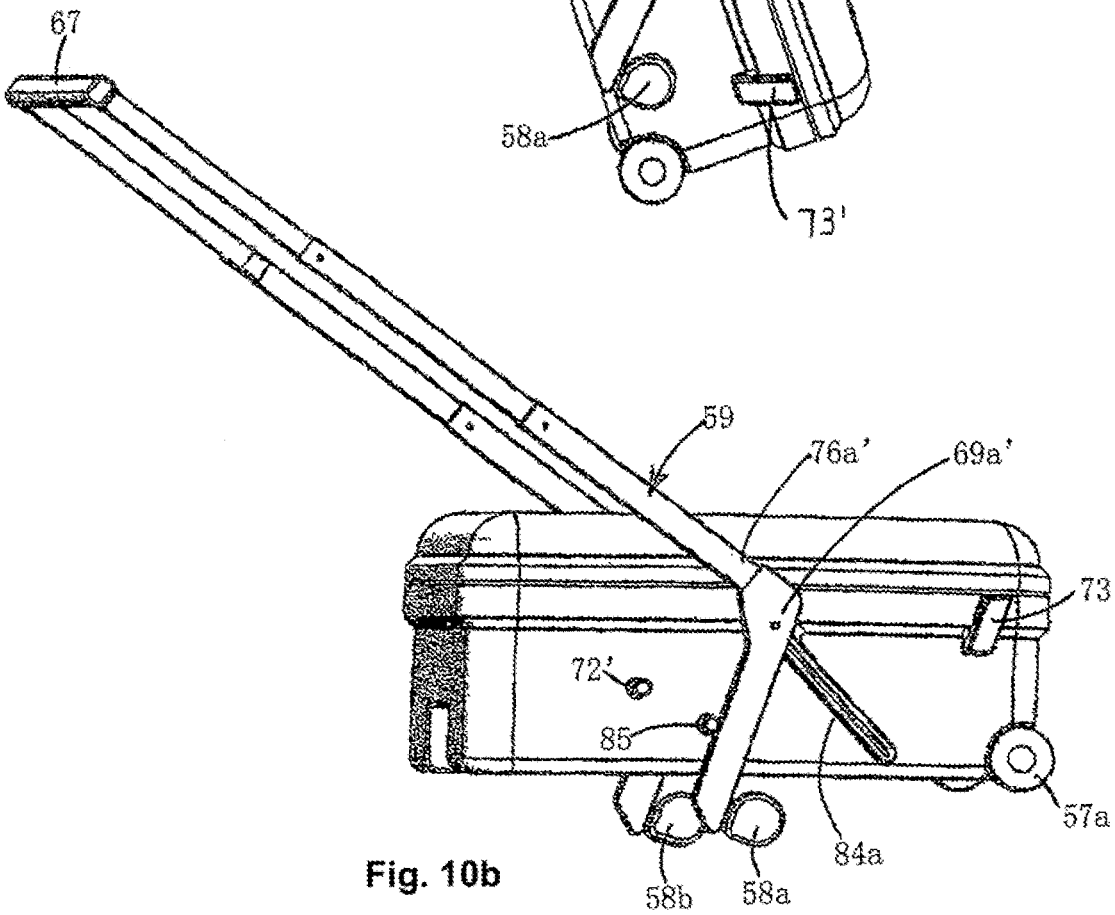
FIG. 10*b* and each of 10*c* and 10*d* show successive stages in the deployment of the integrated handle and steering wheel assembly of FIG. 10*a;*
Figure 10C:
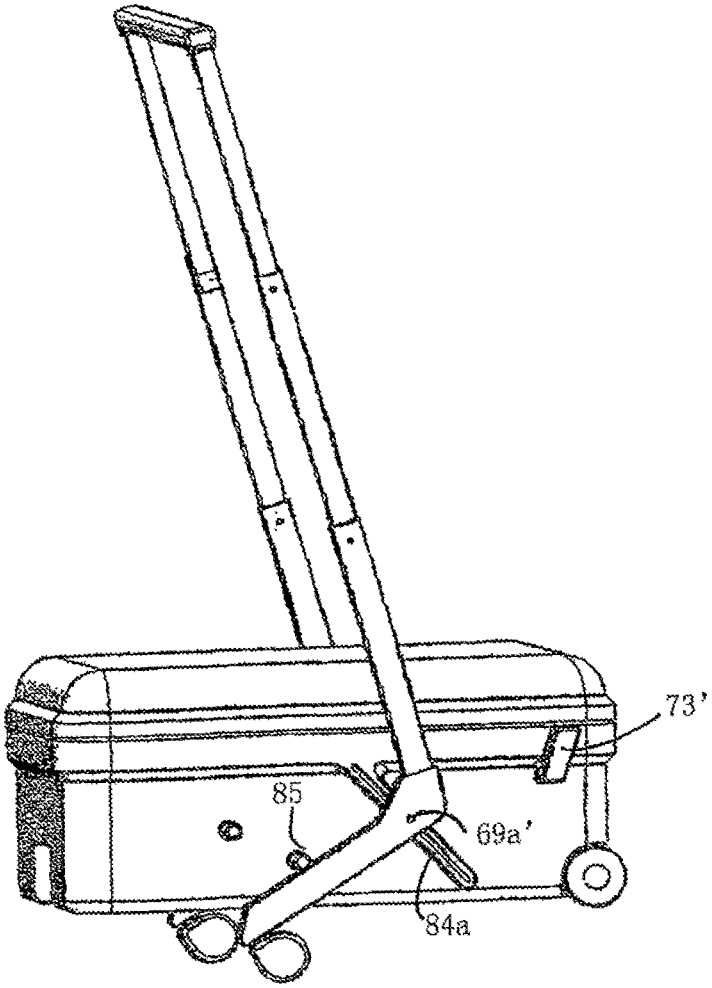
FIGS. 10 to 12 illustrate a second preferred embodiment, where
Figure 10D:
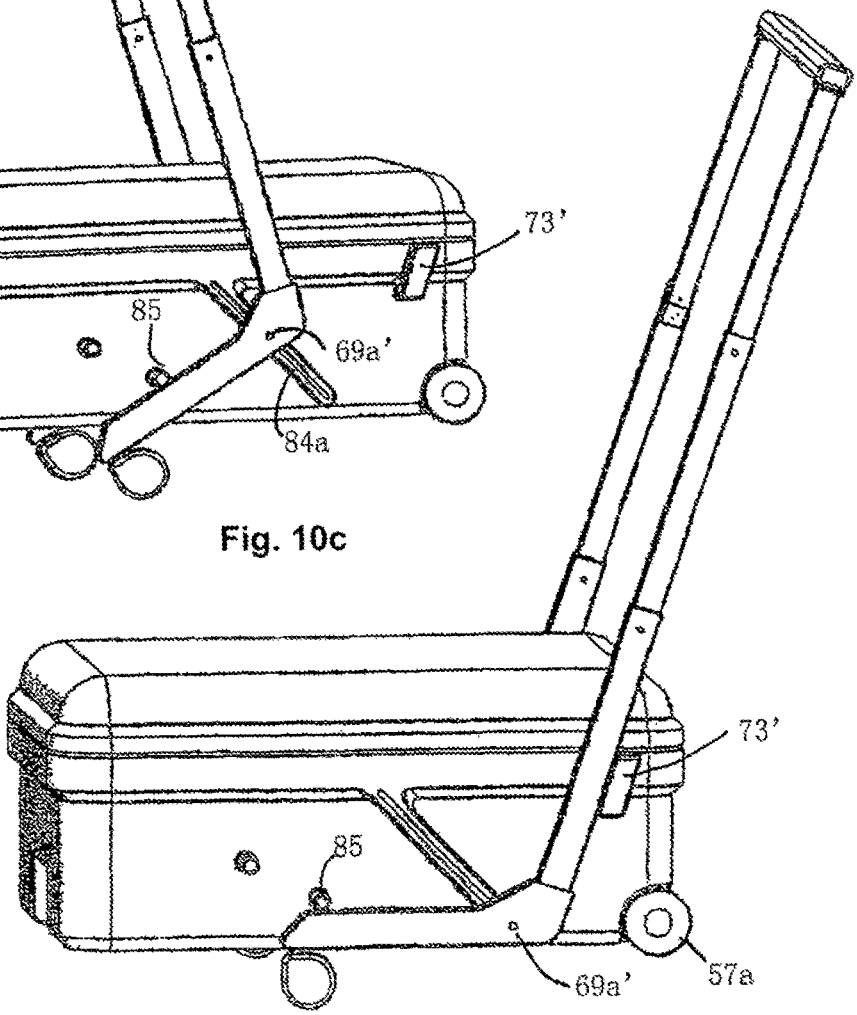

69*a*', 69*b*' that is constrained to slide along a respective channel 84*a*, 84*b* in the respective case side wall. The arms 76*a*', 76*b*' of the handle 59 are straight, not curved, but telescopically extend in substantially the same way as the arms 76*a*, 76*b* of the first embodiment and the deployment motion of the handle 59 and steering wheel assembly 58*a*, 58*b* is very similar to that of the first embodiment, whereby the handle bar 67 is initially angled somewhat downwardly relative to the bottom wall 60 of the case when the wheels 58*a*, 58*b* are in the stowed state (FIG. 10*a*) but ends up flipped over to be directed upwardly and inclined away from the luggage case toward the user (FIG. 10*d*). This second embodiment has a first end stop 72' against which the handle arm 76*a*', 76*b*' rests when in the stowed state and has a further end stop 73' against which the arm 76*a*, 76*b*' rests when in the steering wheel active state. Between these two positions a further detent 85 functions as a detent and secondary pivot about which the handle 59 turns as the primary pivot 69*a*', 69*b*' is forced to slide down the respective channel 84*a*, 84*b*. This detent 85 also serves as an end stop for the active position of the steering wheel assembly 58*a*, 58*b* when the primary pivots 69*a*', 69*b*' reach the ends of their respective channels 84*a*, 84*b*.

Figure 11:
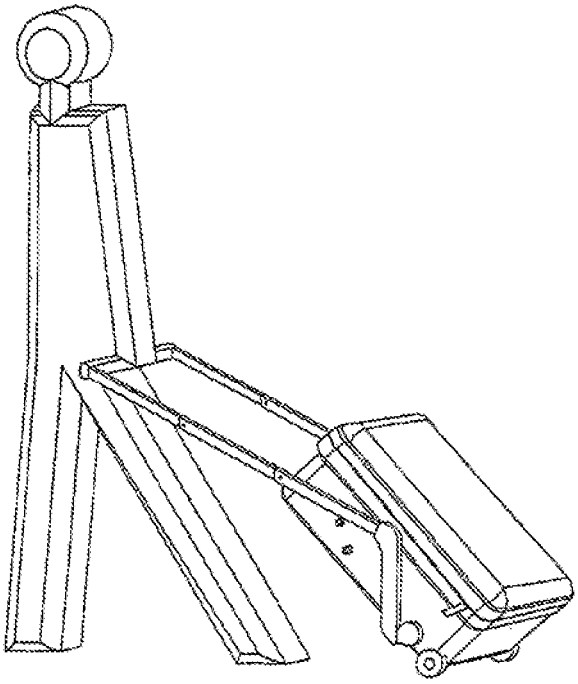
Figure 12:
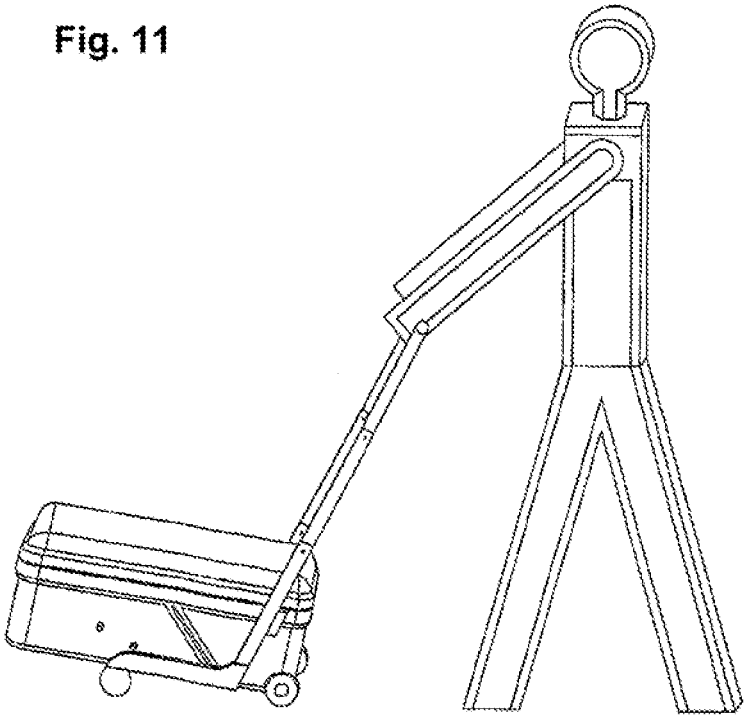

Referring to FIGS. 11 and 12, these show the two alternative end states of the handle 59 and associated steering wheel assembly 58*a*, 58*b*. In FIG. 11 the handle 59 is in its inactive position with the steering wheels 58*a*, 58*b* stowed alongside the side walls of the case and in this position the user can comfortably pull along the case by the handle bar 67 with the case tilted at an angle and rolling along its fixed support wheels 57*a*, 57*b*. In the FIG. 12 steering wheel deployed configuration, the user is able to pull or drive the case in the manner of a trolley. As will be appreciated from these drawings, this and all other embodiments of the invention are particularly preferably arranged such that the steering wheel assembly as deployed holds the base wall at an incline to the ground forming an acute angle with respect to the ground and with the base wall inclined upwardly away from the support wheels. This greatly improves user comfort and maneuverability.

As will be appreciated from FIGS. 10*a* to 12, the simple act of deploying the handle 59 by moving it relative to the case not only co-activates the steering wheel assembly but also moves it from one mode of wheeled travel to another mode of wheeled travel, each of which presents the handle 59 to the user at a convenient angle and position relative to the case. In the FIG. 11 position, the user has good stride clearance and a reasonably comfortable height of the handle bar 67 and in the FIG. 12 position the user has a substantially optimal configuration of the handle relative to the case for use in trolley travel mode.

Figure 13A:
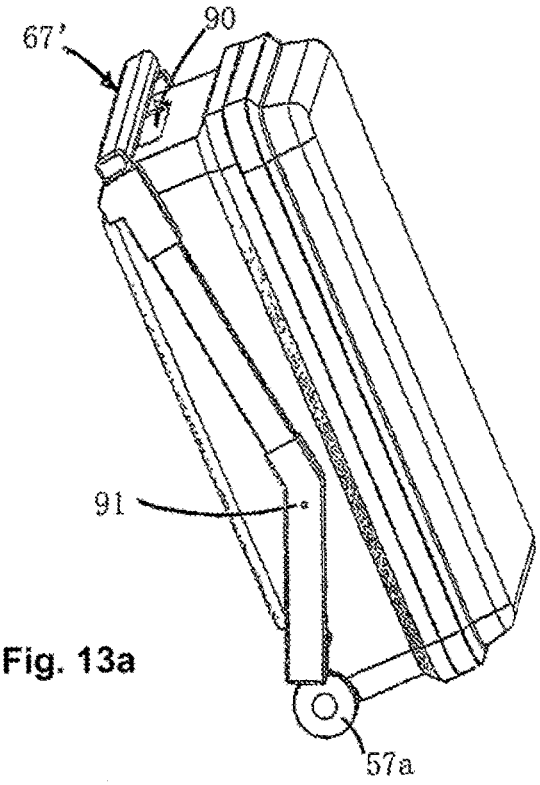
FIGS. 13*a* to 13*c*, respectively, show a further embodiment of the invention, firstly in upright, tilted wheeled travel mode, then in mid-deployment of the steering wheel assembly for trolley travel mode and secondly with the steering wheel assembly fully deployed for trolley travel (this embodiment differs from the preceding one primarily in that it has a fixed location of pivotal mounting of the handle)
Figure 13B:
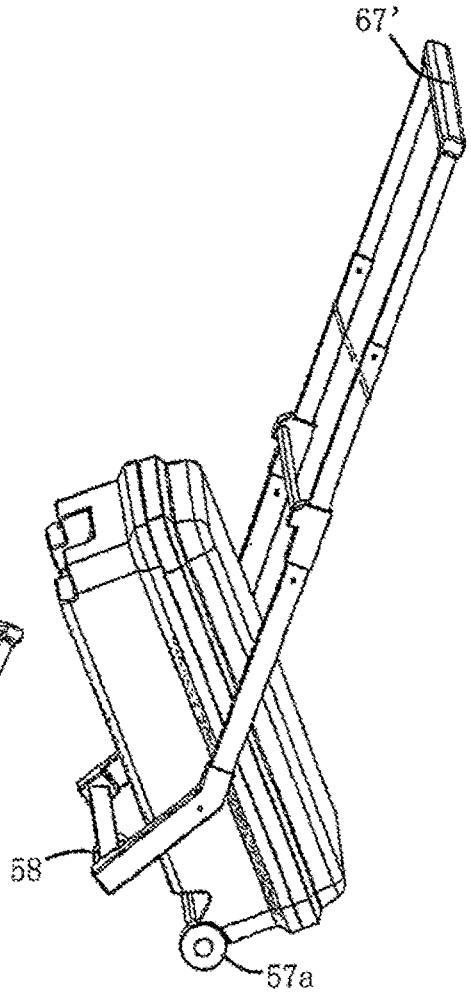
Figure 13C:
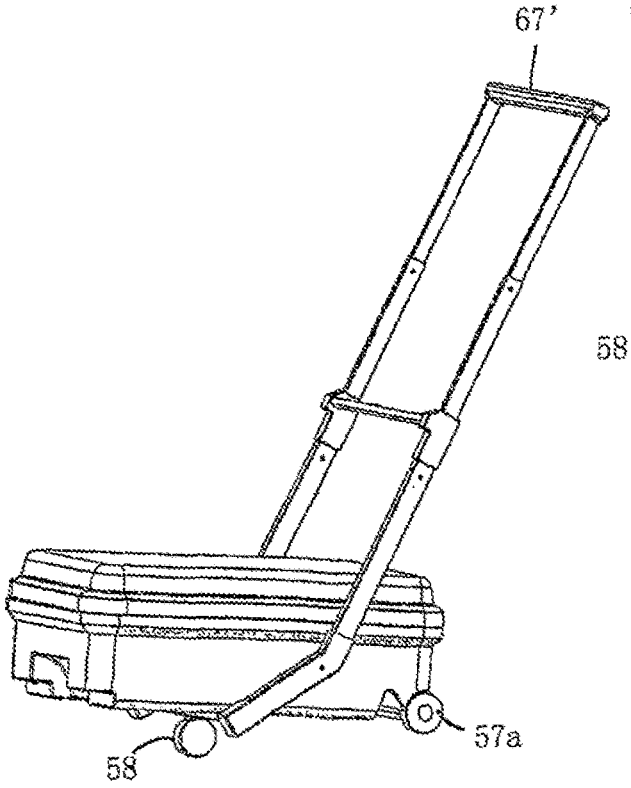

The next embodiment of the invention illustrated in FIGS. 13*a* to 13*c* has the handle stems of the handle 59 directly pivotally attached to the case side walls by static pivots 91 and has the handle pivoting through only a limited angle of movement to deploy the steering wheel assembly 58 to the activated position. This embodiment has generally straight, not curved, handle stems/arms of which the lowermost ends are at an angle relative to the main lengths of the arms. This arrangement is particularly simple in design and operation relative to the preceding embodiment. For some uses a latch arrangement may be provided to hold the steering wheel assembly securely in the active position. A latch or lock to hold the handle in the stowed position is also particularly preferably provided for secure handling in the upright, tilted mode of wheeled travel and facilitates use of the handle 59/handlebar 67' for both modes of wheeled travel. A rebate 80 for retaining the stowed handlebar 67' is provided on the FIG. 13 embodiment and functions in the same manner as the rebate 80 of the first embodiment. A recess or cut-out 90 in the endwall of the luggage case receptacle adjacent the stowed position of the handlebar 67' suits gripping access to the handle bar 67' when it is stowed.

Figure 14:
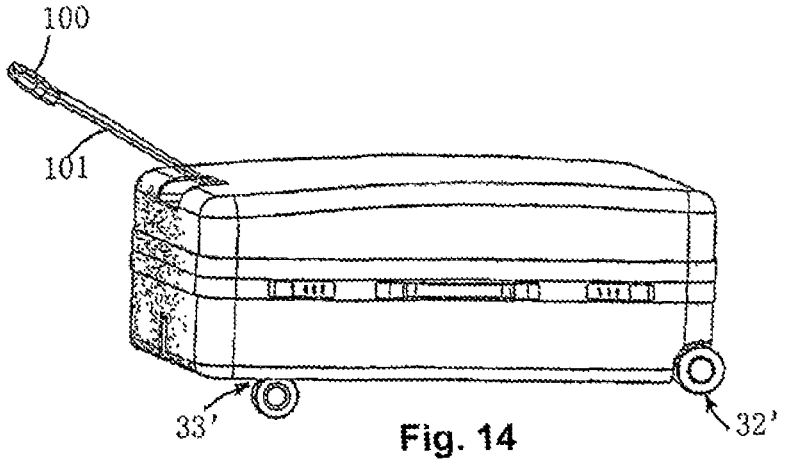
FIG. 14 is a perspective view from above of a variant of the wheeled luggage case having a strap as a handle for pulling the case when it is in its recumbent wheeled mode of travel.
Figure 15A:
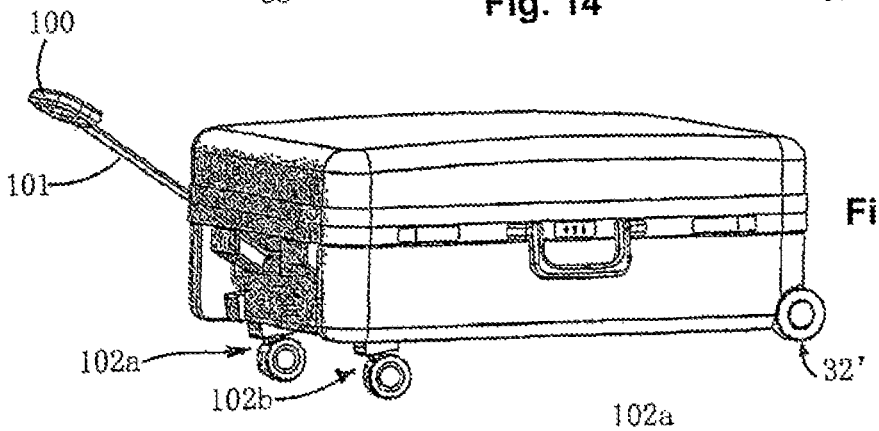
FIGS. 15*a* to 15*c* illustrate a further embodiment of the invention and are, respectively, a perspective view of a luggage case with tape handle mounted proximate to the bottom wall of the luggage case and thereby facilitating use of the luggage case in the upright, tilted mode of travel—FIG. 15*a* has the case in its recumbent mode of travel (referred to as trolley travel mode for the preceding embodiments but which is perhaps better described as a trailer mode of travel in view of the use of the tape handle)
Figure 15B:
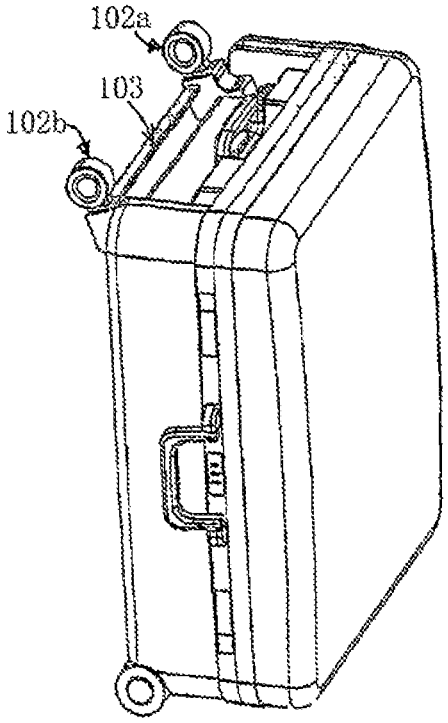
Figure 15C:
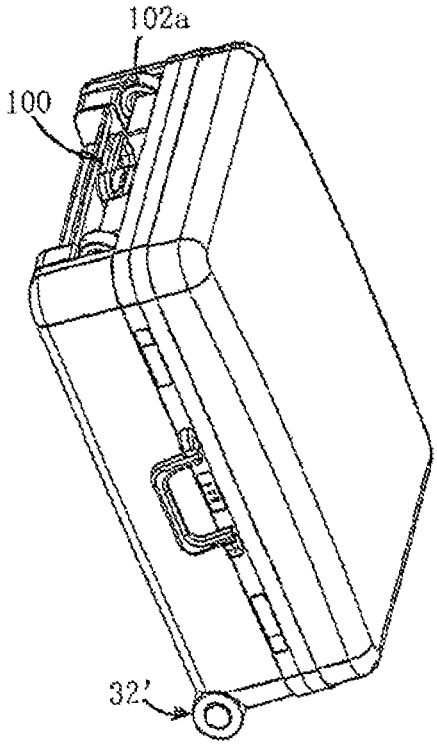

In FIG. 14 the case has a handle 100 comprising a flexible strap 101 instead of a rigid/pushable handle stem. This is lightweight and retractable to a compact form and suitably may be locked at any of a number selected lengths of extension to suit the user and different modes of use. FIG. 15 shows a further case, here having a pair of flip-down steering wheels 102*a,b* linked by a cross member 103. Here the handle 100 is closer to the bottomwall of the case and thus easier to use for tilted upright travel mode. Indeed, the strap 101 is not extending from the lid unlike the FIG. 14 arrangement and can thus provide better support to the case in upright tilted mode.

Figure 16A:
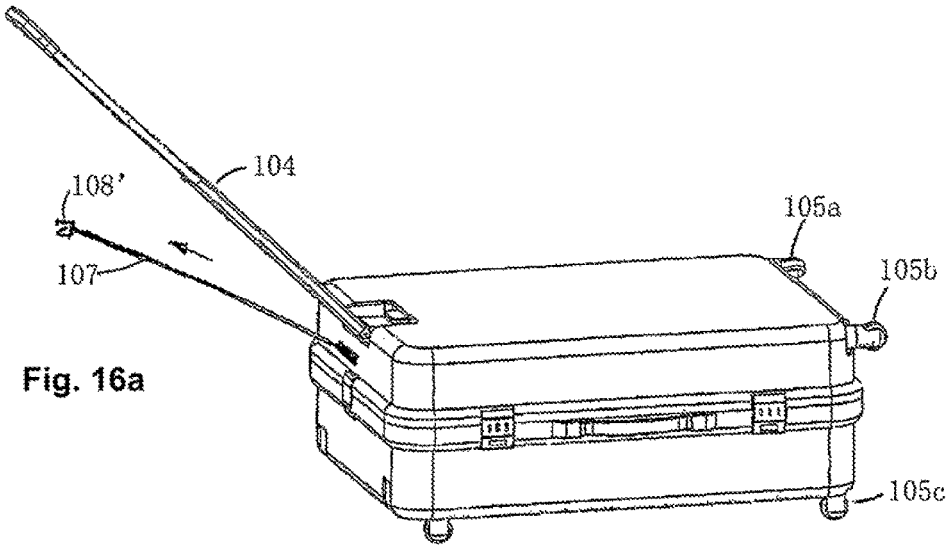
FIGS. 16*a* to 16*d* are views of a further embodiment of the luggage case in which the case, like the first preferred embodiment, has a set of four multi-directional wheels mounted to its end wall opposite the handle that pushes/pulls the case but which differs in that one pair of that set of four wheels that lie at the juncture with the bottom wall are tiltable through substantially 90° so that they can be selectively moved into a position to serve as support wheels for the bottom wall when the luggage case is in the recumbent wheeled mode of travel (trolley mode)
Figure 16B:
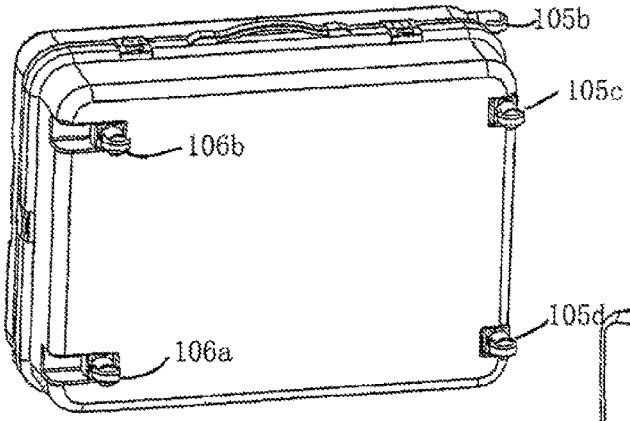
Figure 16C:
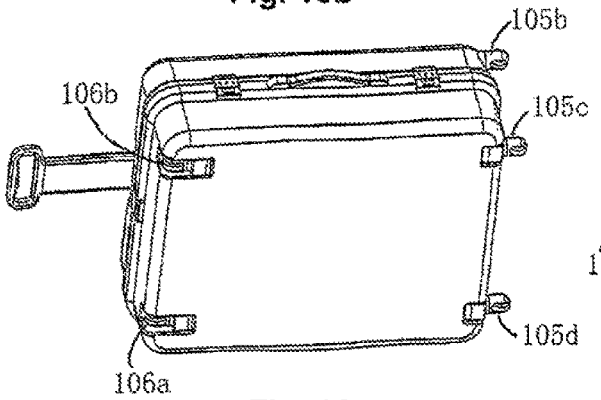
Figure 16D:
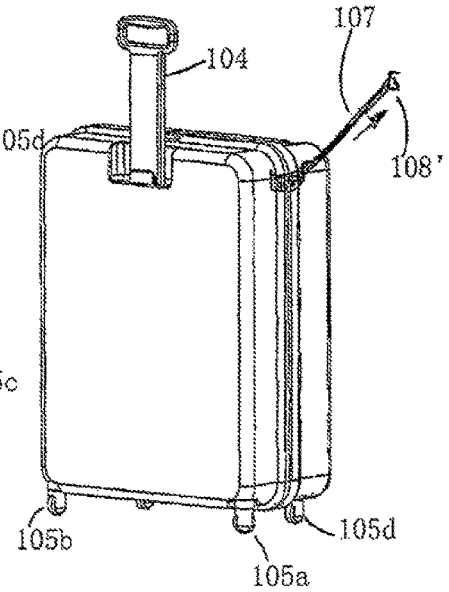

Referring to FIGS. 16A-d, the case there notably has a rigid telescopic handle 104 and a pair of tiltable wheels 105*c* 105*d* that can support the case in trolley travel or in upright travel by being pivoted about the edge of the endwall. A further feature is a strap 107' with a clip 108' that can be used to pull the case along and which can be dipped to a belt of the user, for example, for the case to be pulled along hands free. FIGS. 16*a* and 16*d* show two alternative useful attachment points for the strap 107'.

Figure 17A:
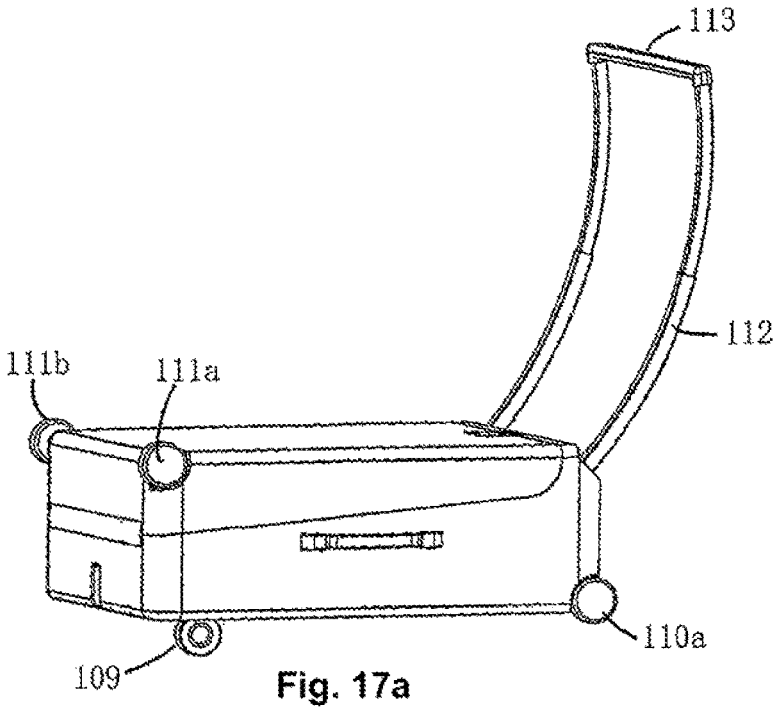
FIGS. 17*a* to 17*c* illustrate a further variant of the luggage case with a tricycle/tripod configuration of wheels when in the trolley mode of wheeled travel and having a set of two further uni-directional wheels mounted to the end of the case opposing the handle and proximate the upper face of the case to suit use of the handle to move the case in the second mode of the travel with the end wall at a moderate tilt to the ground. The curved arrangement of the arms of the handle provide substantial ergonomic benefits in allowing for adequate reach as well as stride clearance in operation of the handle whether in the trolley mode or in the tilted upright mode.
Figure 17B:
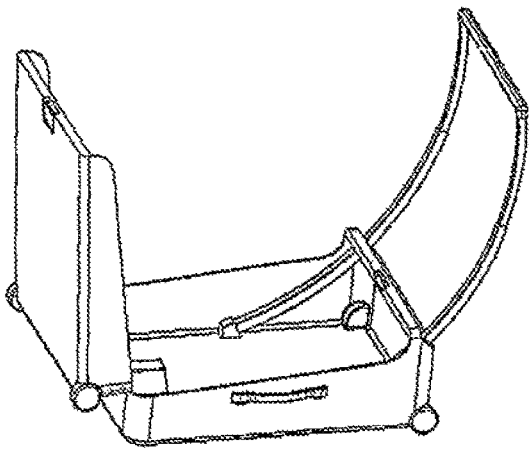
Figure 17C:
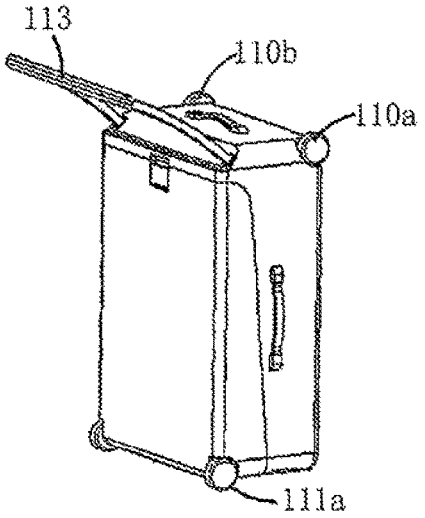

FIGS. 17*a-c* illustrates a variant of case that has a curved telescopically extending handle 112,113 and steering wheel assembly 109 and support wheels 110*a* but also an extra set of two wheels 111*a*,111*b* usable when the case is to be pulled upright at a tilt.

Figure 18A:
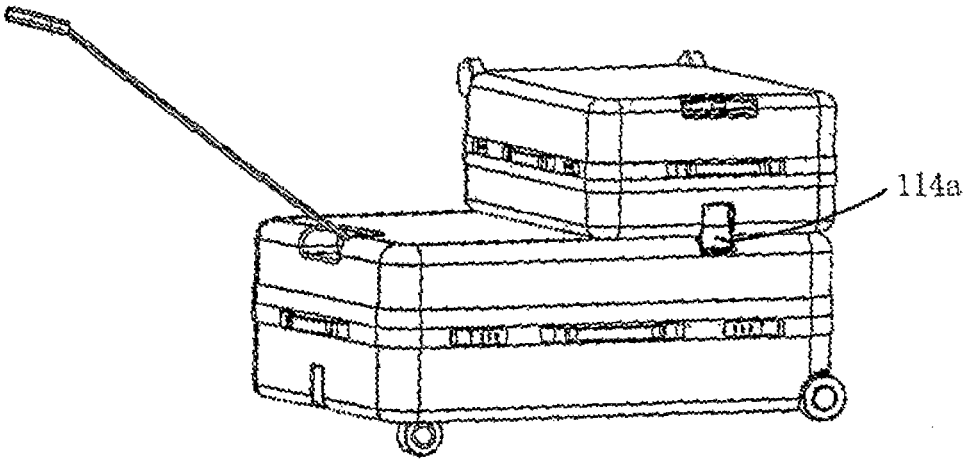
FIGS. 18*a* and 18*b* illustrate adaptations of the luggage case for stacking together multiple such cases and in which a clamp/clasp is provided having a latching clasp member on a wall of one case that swings into latching co-operative engagement with a feature on a wall of another case that is stacked against it.
Figure 18B:
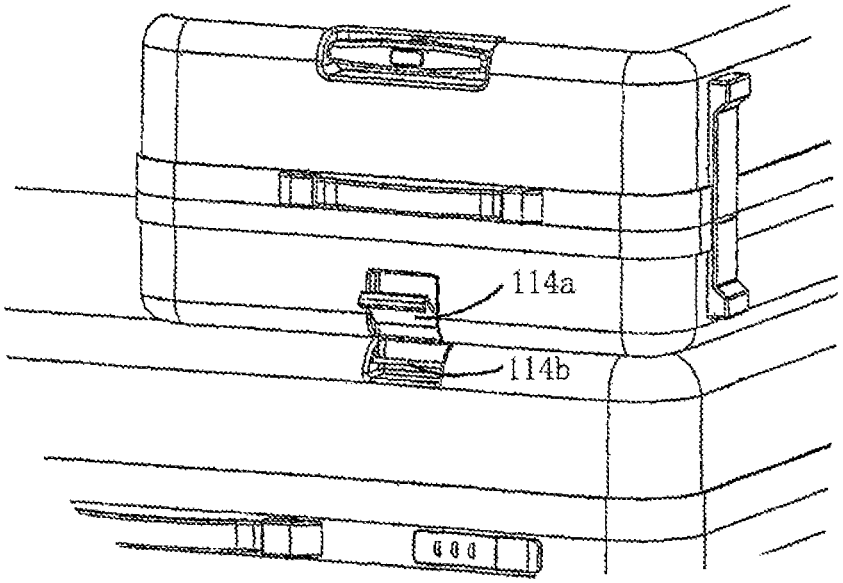
Figure 19A:
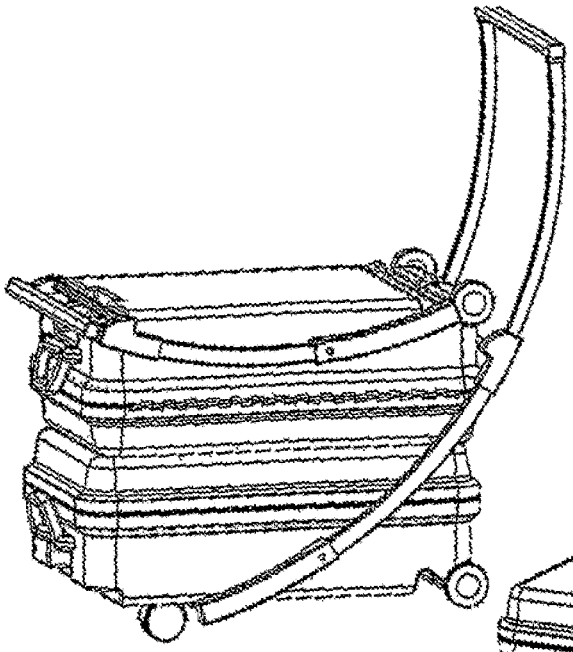
FIGS. 19*a* to 19*c* illustrate details of nesting of stacked cases and which may be stacked top against top as illustrated in FIG. 19*a* or bottom against top as illustrated in FIG. 19*b* and the top/lid surface of each case has recesses in the corners thereof to accommodate the support wheels of the adjacent stacked case.
Figure 19B:
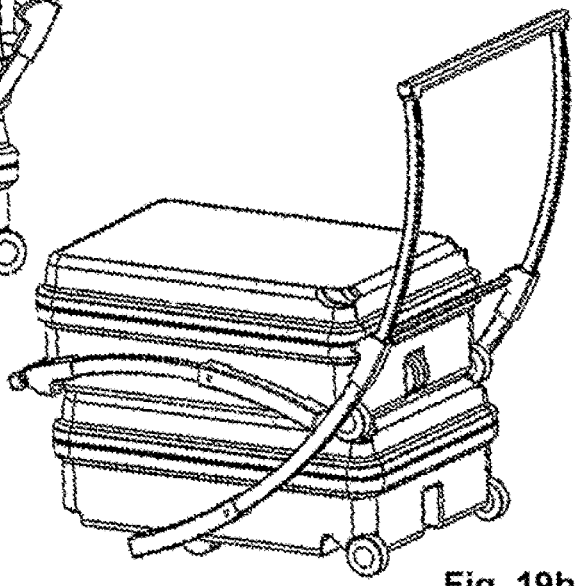
Figure 19C:
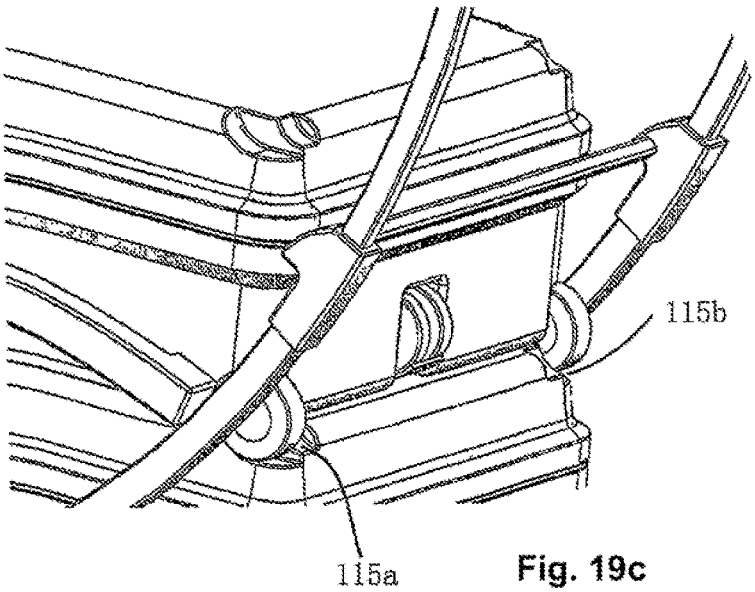
Figure 20A:
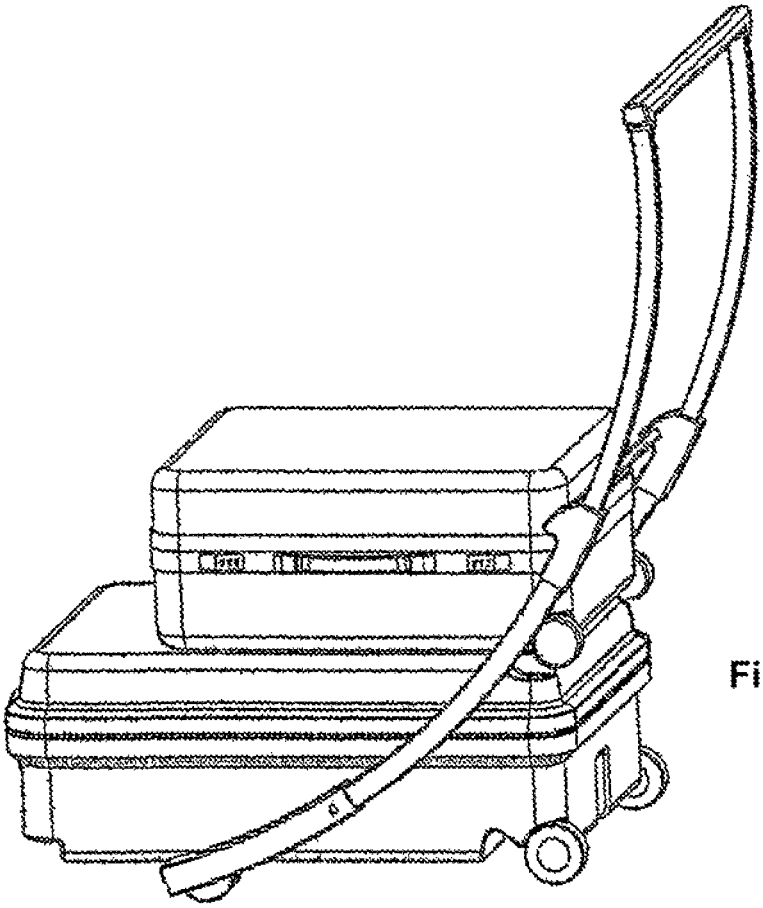
FIGS. 20*a* and 20*b* illustrate an equivalent arrangement of luggage cases of differing size constituting a set of luggage.
Figure 20B:
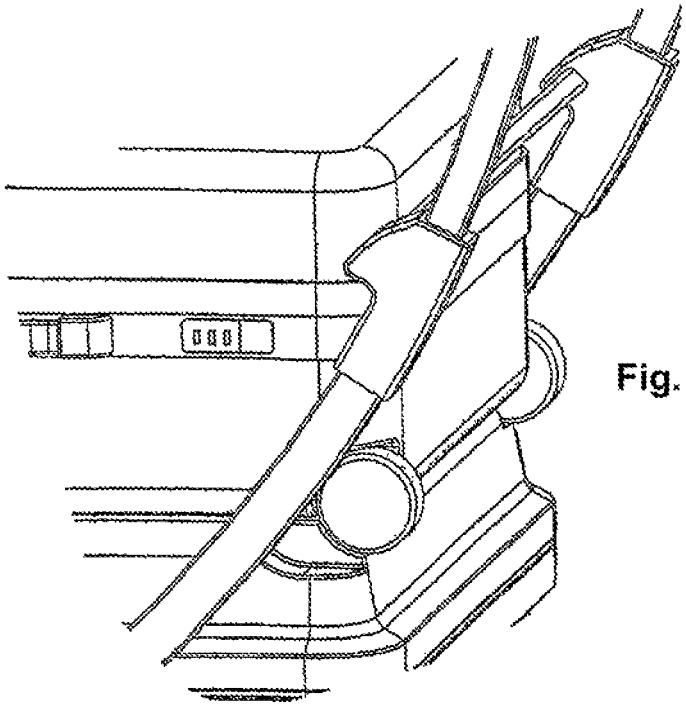

In FIGS. 18*a* and *b* that illustrate the ease of stackablity of cases of the invention and how they may be clamped together, the latching clasp 114*a* on one case latches onto a co-operative engaging feature (eg bar or shoulder) 114*b* on an adjacently stacked case. In FIGS. 19*a-c* the nesting of the cases is facilitated by wheel-accommodating recesses 115*a*, 115*b* in the lids of the cases.

It should be appreciated that the steering wheel assembly may comprise a plurality of steering wheels and not simply one wheel.

The present invention provides a new design that is especially useful for larger size travel suitcase but that may be used for a diverse range of sizes, shapes and types of case. It is easily portable with minimal effort and is highly maneuverable, stable and convenient to use. The suitcase has a light-weight, robust, trolley or trailer-type design with a retractable push handle and retractable wheels and has a number of major advantages over the prior art.

The wide base and a low centre of gravity of the case in trolley/trailer travel mode is inherently more stable compared to various traditional suitcase designs. Unlike cases towed on wheels at an incline (e.g. U.S. Pat. No. 5,116,289), this design is self-stabilised and self-supporting during movement. The case is highly maneuverable and the retractable push handle enables the suitcase to be wheeled in an inclined upright manner when the handle and steering wheel assembly are retracted. With contemporary light-weight and tough aluminium alloys or other materials, the retractable handle can be easily manufactured to various design options.

The retractable steering wheel assembly wheels allow the wheels to come into play only when needed and avoids potential damage of exposed wheels during luggage transfer. The case may have two small light-weight roller blade-like rear wheels/support wheels that will only come into play when the 'cart' is tilted. The steering wheel assembly in the front suitably tilts the case to bring those rear wheels/support wheels into play and enables the case to function as a trolley or trailer. This design minimises bulk and weight on the case itself and makes the case practical and convenient to use. The push-trolley suitcase design is ergonomically suited for moving large and heavy loads. Furthermore, it is easier to push than to pull a heavy load. This push-trolley suitcase design enables one to cart a heavy suitcase load with more control and with much less effort. Furthermore, this trolley suitcase design can also be adapted for pulling purposes such as reversing from a right corner and reversing down from a step. The push trolley suitcase design can be used as a push trolley in itself. Other luggage can be piled on top of it and carted around as with the use of an airport or train station push trolley. The case is suitably of contemporary plastic or other material that is tough, light-weight and strong or may, for example, use a tough canvass or other tough material with aluminium/other metal/alloy skeletal frame reinforcement.

Where the base of the suitcase is at an incline when the retractable wheel is in use, this helps to bring the hind-wheels into play, and shifts the centre of gravity backwards towards the hind-wheels to improve stability on the tricycle and maneuverability of the front multidirectional wheel. It also tilts the handle bar backwards to allow for foot clearance when walking and pushing the case and keeps the stacked luggage on the trolley in place.

It will be appreciated that a retractable steering wheel assembly as illustrated and as described above could be employed in a luggage case where the steering wheel assembly and support wheels were of substantially equivalent size.

The "push trolley" mode of wheeling the luggage suitcase is advantageous over the conventional mode of wheeling luggage suitcases for several reasons. These include:

(a) improved ergonomics for transporting luggage on wheels;

(b) less effort being required to push a load than to pull the same load using one's own body weight to aid in pushing the load;

(c) a low centre of gravity and a wide base confers maximum stability;

(d) the wheeling configurations and particularly tricycle wheeling configuration provide optimal maneuverability;

(e) the wheeling system is self-supporting and does not require the user to expend effort in balancing the case;

(f) the case can be used as a cart for other items of luggage to be piled on top of it and carted around;

(g) as noted above, the wheeled luggage case can easily be adapted to push pram or wheelchair function with appropriate accessorial attachments (for example, a seat attachment) and safety modifications (for example, brake incorporation).

In addition to the push trolley function, the push trolley suitcase can conveniently be converted into a pushchair or pram for babies or toddlers with suitable accessorial and safety attachments. Alternatively or additionally the case may be adapted as a powered vehicle/automobile for riding by a passenger.

The new provision of a means for deploying the steering wheel assembly via the handle effectively enables a one-step deployment operation to activate the trolley mode of function and greatly optimises the ease and convenience of activating and deactivating this push trolley function. The case can also be changed between different modes of wheeled travel with ease.

The new dual function convertible trolley configuration of the present invention is self-supporting, has a low centre of gravity and wide base, and thus is stable, maneuverable without toppling, ergonomic, easy to push (optional use of body weight) than pull load, easy to pile other luggage on case (largest surface area possible for each case, initial stability with low centre of gravity and broad base) and very versatile. It can have one step deployment compared to the two-step deployment in our earlier 'trolley' invention and has dual function (cart and trolley) with the respective advantages of both function with virtually no extra 'mechanism'/weight.

In the trailer aspect, the configuration is generally much lighter than the trolley arrangements and can be lighter than 'cart' and 'spinner cases' through having no telescoping handle and housing. The arrangement is less strenuous in transit compared to cart and spinner cases and more ergonomic than cart and spinner cases. The case is self-supporting, has a low centre of gravity and wide base, thus stable, is maneuverable without toppling, easy to pile other luggage on case and opens up the potential for hands-free function for small (and possibly medium) size cases, including computer/business/brief cases etc. What is more, significantly less vibrations are transmitted to hand during case transit on rough surface (eg road) compared to cart, spinner or trolley cases. The case is also feasibly cheaper to manufacture compared to the trolley arrangements and can be cheaper to manufacture compared to Cart and Spinner cases too. The case is also potentially less strenuous (up-slope) or less difficult to control (down-slope) compared to cart and spinner cases.

A yet further facility provided by the trolley or trailer configurations of the case of the present invention is the ability of the case to climb steps while in that travel mode. Indeed the case may be adapted to further have skids or rollers on its bottomwall to exploit the proximity of that wall to the ground and relative ease by which it may be 'slid' or otherwise maneuvered up or down steps without risk of toppling.

The invention claimed is:

1. A wheeled luggage case, comprising:

a luggage receptacle, the receptacle having first and second opposing major walls, front and rear end walls, and first and second side walls, all forming a luggage compartment, wherein the major walls are the largest of the major walls, end walls and side walls, wherein the first major wall of the receptacle is adapted to serve as a bottom wall that closely faces the ground during a wheeled mode of travel of the luggage case;

a plurality of unidirectional and non-retractable rear support wheels located at a rear end of the bottom wall;

a retractable front steering wheel assembly, mounted to the bottom wall, distanced, in use, from the support wheels, toward a front end of the bottom wall, said steering wheel assembly having at least one wheel and being moveable between an active position at which the steering wheel assembly extends below the bottom wall of the luggage receptacle and an inactive position at which the at least one wheel is retracted above the bottom wall; and a handle located toward the front end of the luggage receptacle for steering and pulling purposes;

wherein the luggage case is configured to be deployable in a mode of wheeled travel with the retractable steering wheel assembly and support wheels in ground engagement whereby the said bottom wall is facing the ground, the handle comprising an angularly mobile linkage, by means of which the luggage case may be pulled along in said mode of travel;

wherein, the front steering wheel assembly, in its active position, is configured to extend further from the bottom wall than the fixed rear support wheels to hold the bottom wall at an incline to the ground when all wheels are located on substantially flat ground, such that a lesser portion of the forces acting on the luggage receptacle will act through the front steering wheel assembly than if the bottom wall was parallel to the substantially flat ground, so as to improve maneuverability of the luggage case.

2. A wheeled luggage case as claimed in claim 1, wherein the handle functions as a belt or harness whereby the handle may be fastened to the user or an article worn by the user to be pulled along by the user in a hands free manner.

3. A wheeled luggage case as claimed in claim 1, wherein the case is adapted to be used as a vehicle for a passenger, having at least one of a seat, a footrest, and a backrest.

4. A wheeled luggage case according to claim 1, wherein the retracted handle has a member that nests into a rebate of the receptacle when stowed, whereby the handle is retained.

5. A wheeled luggage case according to claim 1, wherein a luggage case endwall has a plurality of multidirectional wheels whereby the case may be used upright on those wheels, at least one of those wheels being tiltable so as to be selectively used as a support wheel extending below the bottom wall.

6. A wheeled luggage case as claimed in claim 1, wherein the luggage case has a further set of one or more wheels that are provided on an end wall of the luggage case that is remote from the said handle whereby the case may be used upright on those wheels.

7. A wheeled luggage case as claimed in claim 1, wherein the angularly mobile linkage is a flexible tape or strap.

* * * * *